US011874040B2

(12) United States Patent
Ferretti et al.

(10) Patent No.: US 11,874,040 B2
(45) Date of Patent: Jan. 16, 2024

(54) REFRIGERATION SYSTEMS WITH A FIRST COMPRESSOR SYSTEM AND A SECOND COMPRESSOR SYSTEM

(71) Applicant: Hill Phoenix, Inc., Conyers, GA (US)

(72) Inventors: Peter J. Ferretti, Monroe, GA (US); Victor N. Votary, Proton Station (CA); Jeffrey Newel, Snellville, GA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 17/583,002

(22) Filed: Jan. 24, 2022

(65) Prior Publication Data

US 2022/0146168 A1 May 12, 2022

Related U.S. Application Data

(62) Division of application No. 16/541,746, filed on Aug. 15, 2019, now Pat. No. 11,280,531.

(60) Provisional application No. 62/721,961, filed on Aug. 23, 2018.

(51) Int. Cl.

| | |
|---|---|
| ***F25B 49/02*** | (2006.01) |
| ***F25B 47/02*** | (2006.01) |
| ***F25B 41/22*** | (2021.01) |
| ***F25B 41/31*** | (2021.01) |
| ***F25B 29/00*** | (2006.01) |

(52) U.S. Cl.

CPC ..... *F25B 49/02* (2013.01); *F25B 41/22* (2021.01); *F25B 41/31* (2021.01); *F25B 47/022* (2013.01); *F25B 29/003* (2013.01); *F25B 2347/02* (2013.01); *F25B 2400/19* (2013.01)

(58) Field of Classification Search

CPC F25B 2347/02; F25B 2400/19; F25B 29/003; F25B 41/22; F25B 41/31; F25B 47/022

See application file for complete search history.

(56) References Cited

U.S. PATENT DOCUMENTS

| | | | | |
|---|---|---|---|---|
| 11,280,531 | B2 | 3/2022 | Ferretti et al. | |
| 2014/0208785 | A1* | 7/2014 | Wallace | F25B 49/02 62/190 |
| 2015/0345835 | A1* | 12/2015 | Martin | F25B 15/06 62/238.3 |
| 2017/0284706 | A1* | 10/2017 | Ozu | F25B 31/002 |
| 2018/0202702 | A1* | 7/2018 | Zha | F25D 17/005 |
| 2018/0252441 | A1* | 9/2018 | Zha | F25B 43/006 |
| 2018/0306491 | A1 | 10/2018 | Saunders et al. | |
| 2019/0072299 | A1* | 3/2019 | Najafifard | F25B 41/20 |
| 2019/0376732 | A1* | 12/2019 | Zha | F25B 47/025 |

(Continued)

*Primary Examiner* — Henry T Crenshaw

(74) *Attorney, Agent, or Firm* — Fish & Richardson P.C.

(57) ABSTRACT

A refrigeration system includes a first compressor system, a second compressor system, a first conduit, a heat exchanger, a second conduit, and a third conduit. The first compressor system includes a plurality of first compressors. The second compressor system includes a plurality of second compressors. The first conduit is configured to provide refrigerant from the first compressor system to the second compressor system. The second conduit is fluidly coupled to the first conduit and configured to provide the refrigerant from the first compressor system to the heat exchanger. The third conduit is configured to provide the refrigerant from the second compressor system to the heat exchanger.

29 Claims, 18 Drawing Sheets

(56) References Cited

U.S. PATENT DOCUMENTS

| | | | | |
|---|---|---|---|---|
| 2020/0064037 | A1* | 2/2020 | Ferretti | F25B 41/31 |
| 2022/0205696 | A1 | 6/2022 | Ferretti et al. | |

* cited by examiner

REFRIGERATION SYSTEMS WITH A FIRST COMPRESSOR SYSTEM AND A SECOND COMPRESSOR SYSTEM

CROSS-REFERENCE TO RELATED PATENT APPLICATION

This application is a divisional application of and claims priority to U.S. application Ser. No. 16/541,746, filed on Aug. 15, 2019, which claims priority under 35 U.S.C. § 119 to U.S. Application Ser. No. 62/721,961, filed on Aug. 23, 2018, the entire contents of each of which are incorporated herein by reference.

BACKGROUND

The present application relates generally to system for defrosting a refrigeration system. In particular, this application relates to a refrigeration system which includes a heat exchanger for heating gas used to defrost the refrigeration system Generally speaking, components of a refrigeration system tend to accumulate frost and/or ice during use. For example, frost may accumulate on evaporator tubes and fins. Accumulation of frost and/or ice may cause a reduction in the efficiency of the refrigeration system (e.g., due to a reduction in the efficiency of an evaporator, etc.). Thus, it is desirable to remove this frost and/or ice in order to maintain desirable efficiency of a refrigeration system during use.

Frost and/or ice may be removed from a refrigeration system through the use of a defrost system. The defrost system functions to melt the frost and/or ice such that frost and/or ice phase shifts into a liquid, which is subsequently evacuated from the refrigeration system. An example of a defrost system is a gas defrost system. Gas defrost systems utilize internal energy from a refrigeration system to melt the frost and/or ice. For example, a gas defrost system may utilize high temperature discharge gas from the refrigeration system to melt the frost and/or ice. However, gas defrost systems may be unable to adequately defrost larger refrigeration systems. For example, gas defrost systems may be unable to provide gas at a target mass flow rate associated with adequate defrosting of a refrigeration system. Additionally, gas defrost systems may be unable to heat the gas sufficiently enough to adequately defrost larger refrigeration systems.

SUMMARY

One embodiment of the present disclosure is related to a refrigeration system. The refrigeration system includes a first compressor system, a second compressor system, a first conduit, a heat exchanger, a second conduit, and a third conduit. The first compressor system includes a plurality of first compressors. The second compressor system includes a plurality of second compressors. The first conduit is configured to provide refrigerant from the first compressor system to the second compressor system. The second conduit is fluidly coupled to the first conduit and configured to provide the refrigerant from the first compressor system to the heat exchanger. The third conduit is configured to provide the refrigerant from the second compressor system to the heat exchanger.

Another embodiment of the present disclosure is related to a refrigeration system. The refrigeration system includes a first compressor system, a second compressor system, a first conduit, a heat exchanger, a three-way defrost control valve, and a second conduit. The first compressor system includes a first compressor. The second compressor system includes a second compressor. The first conduit is fluidly coupled to the first compressor system and the second compressor system and configured to provide refrigerant from the first compressor system to the second compressor system. The second conduit is fluidly coupled to the second compressor system, the heat exchanger, and the three-way defrost control valve. The three-way defrost control valve is configured to receive the refrigerant from the second conduit upstream of the heat exchanger and receive the refrigerant from the second conduit downstream of the heat exchanger.

Another embodiment of the present disclosure is related to a refrigeration system. The refrigeration system includes a first compressor system, a second compressor system, a first conduit, a defrost control valve, a heat exchanger, a heat exchange conduit, and a return conduit. The first compressor system includes a first compressor. The second compressor system includes a second compressor. The first conduit is configured to provide refrigerant from the first compressor system to the second compressor system. The defrost control valve is disposed along the first conduit. The defrost control valve is configured to control an amount of the refrigerant flowing through the first conduit. The heat exchanger includes a first circuit and a second circuit. The heat exchange conduit is configured to provide the refrigerant from the second compressor system to the first circuit. The return conduit is fluidly coupled to the first conduit downstream of the defrost control valve and configured to provide the refrigerant from the first conduit to the first compressor system.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

I. Overview

A refrigeration system may utilize a gas defrost system to melt frost and ice which accumulates within the refrigeration system. Depending on the configuration of the refrigeration system, it may be difficult to heat the gas enough to adequately melt frost and ice throughout the refrigeration system. For example, when the refrigeration system is relatively large, the gas defrost system may be unable to adequately melt the frost and ice because the gas defrost system is unable to provide gas that has a required minimum mass flow rate and/or a required minimum temperature.

Some of the embodiments described herein are directed towards various refrigeration systems which include at least two separate compressor systems (e.g., three separate compressor systems, etc.) that are capable of operating in parallel. By providing gas from one compressor system to the other compressor system, the refrigeration system is capable of attaining the required minimum mass flow rate for larger refrigeration systems such that the frost and ice are melted adequately. In other embodiments, the refrigeration system described herein only includes one compressor system.

The embodiments described herein are also directed towards various refrigeration systems which include a heat exchanger positioned downstream of the at least one compressor system. The heat exchanger transfers the heat from the refrigerant compressed by more than one compressor system to the refrigerant compressed by only one compressor system. In this way, the gas provided to the defrost system may be heated prior to being utilized by a defrost system for defrosting defrost targets. Each defrost target is contained within a heat load of the refrigeration system (e.g., a cold space created by the refrigeration system, etc.). Through the use of the heat exchanger, the refrigeration system is capable of providing gas to the defrost system at the required minimum temperature.

II. The Refrigeration System

Figure 1:
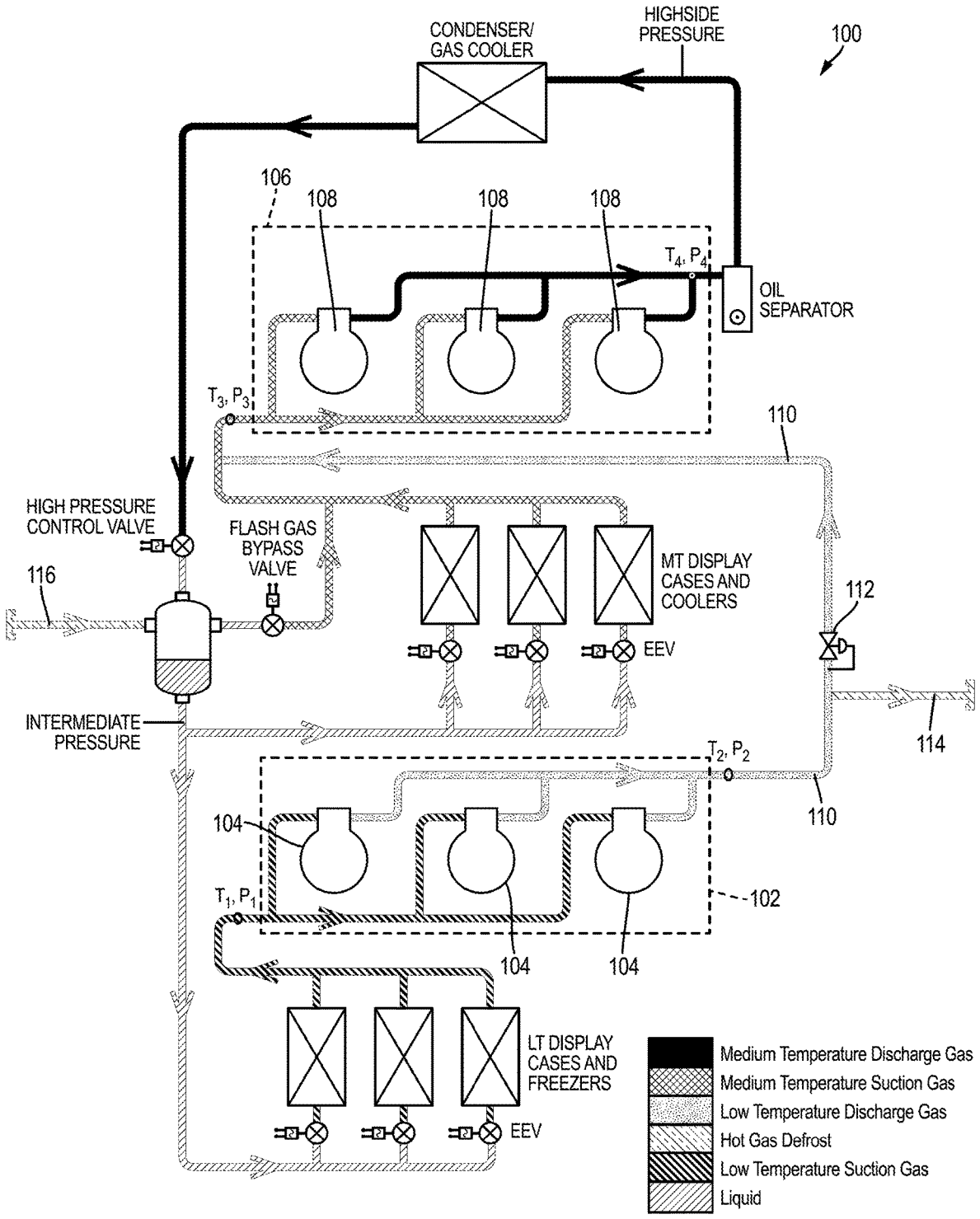
FIG. 1 is a schematic representation of a refrigeration system, according to an exemplary embodiment of the present disclosure.

Referring to FIG. 1, a system (e.g., cooling system, etc.), shown as a refrigeration system 100, is illustrated. The refrigeration system 100 is implemented in at least one refrigerated case (e.g., freezer case, display case, refrigerated display case, etc.) for refrigerating goods (e.g., frozen foods, refrigerated foods, dairy products, beverages, etc.). For example, the refrigeration system 100 may be implemented in a bank of refrigerated cases, each sharing the refrigeration system 100. As will be explained in more detail herein, the refrigeration system 100 functions to provide or discharge hot gas (e.g., superheated gas, etc.) to a gas defrost system for defrosting components of the at least one refrigerated case, such as components of the refrigeration system 100.

The refrigeration system 100 circulates a refrigerant gas. In various locations within the refrigeration system 100, the gas may become saturated and/or phase shift partially to liquid. Additionally, the gas may become superheated at various locations within the refrigeration system 100. In various exemplary embodiments described herein, the refrigeration system 100 utilizes carbon dioxide ($CO_2$) as a refrigerant, which may exist in a liquid and/or gaseous state according to the temperature and pressure conditions throughout the various locations of the refrigeration system 100. In these embodiments, the refrigeration system 100 may be termed a "$CO_2$ refrigeration system." However, in other embodiments the refrigeration system 100 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 100 includes a first compressor system, shown as a low temperature compressor system 102. The low temperature compressor system 102 includes a plurality of compressors, shown as low temperature compressors 104. The low temperature compressor system 102 may include one, two, three, four, or more low temperature compressors 104. The low temperature compressors 104 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 100 includes a second compressor system, shown as a medium temperature compressor system 106. The medium temperature compressor system 106 includes a plurality of compressors, shown as medium temperature compressors 108. The medium temperature compressor system 106 may include one, two, three, four, or more medium temperature compressors 108. The medium temperature compressors 108 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 106 is configured to receive gas from the low temperature compressor system 102 via a conduit (e.g., line, pipe, etc.), shown as a conduit 110. The conduit 110 is coupled to an outlet of the low temperature compressor system 102 and an inlet of the medium temperature compressor system 106. The flow of the gas from the low temperature compressor system 102 to the medium temperature compressor system 106 through the conduit 110 is controlled by a valve (e.g., regulating valve, solenoid valve, ball valve, etc.), shown as a defrost control valve 112. The defrost control valve 112 is disposed along (e.g., positioned on, etc.) the conduit 110. The defrost control valve 112 effectively divides the conduit 110 into two conduits (e.g., portions, etc.). The defrost control valve 112 may be manually controlled or electronically controlled by a central controller (e.g., computer system, etc.). The defrost control valve 112 may include a controller (e.g., processing circuit, memory, control module, etc.) or may be communicable with a controller (e.g., central controller, etc.) configured to control the defrost control valve 112.

The defrost control valve 112 is positioned upstream of a conduit, shown as a defrost inlet conduit 114. The defrost inlet conduit 114 provides refrigerant to defrost targets, such as display cases and evaporators, to be defrosted. By controlling the defrost control valve 112 (e.g., progressively opening the defrost control valve, 112, progressively closing the defrost control valve 112, etc.) more or less gas may be provided or discharged from the low temperature compressor system 102 to the medium temperature compressor system 106 thereby causing more or less gas to be provided from the low temperature compressor system 102 to the defrost inlet conduit 114. When the defrost control valve 112 is closed, the pressure $P_2$ upstream of the defrost control valve 112 increases and additional refrigerant is provided to the defrost inlet conduit 114 and therefore to the defrost targets to be defrosted.

After flowing from the defrost inlet conduit 114 through the defrost targets to be defrosted, the refrigerant is directed through a defrost outlet conduit 116. The defrost outlet conduit 116 provides some of the refrigerant (e.g., liquid refrigerant) to medium temperature (MT) display cases, some of the refrigerant (e.g., vapor refrigerant) to the medium temperature compressor system 106, some refrigerant to low temperature (LT) display cases (e.g., liquid refrigerant), and some of the refrigerant (e.g., vapor refrigerant) to the low temperature compressor system 102.

While not shown in FIG. 1, it is understood that the refrigeration system 100 may include a plurality of valves disposed along the conduit 110, such as at least one valve positioned in series with the defrost control valve 112 and at least one valve positioned in parallel with the defrost control valve 112. These valves may be, for example, a solenoid valve, a relief valve, and other similar valves. In this way, a valve may be configured to open before the defrost control valve 112. For example, a valve may be configured to open more quickly than the defrost control valve 112, in order to prevent pressure from rapidly accumulating in the portion of the conduit 110 that is upstream of the valve and the defrost control valve 112.

Figure 2:
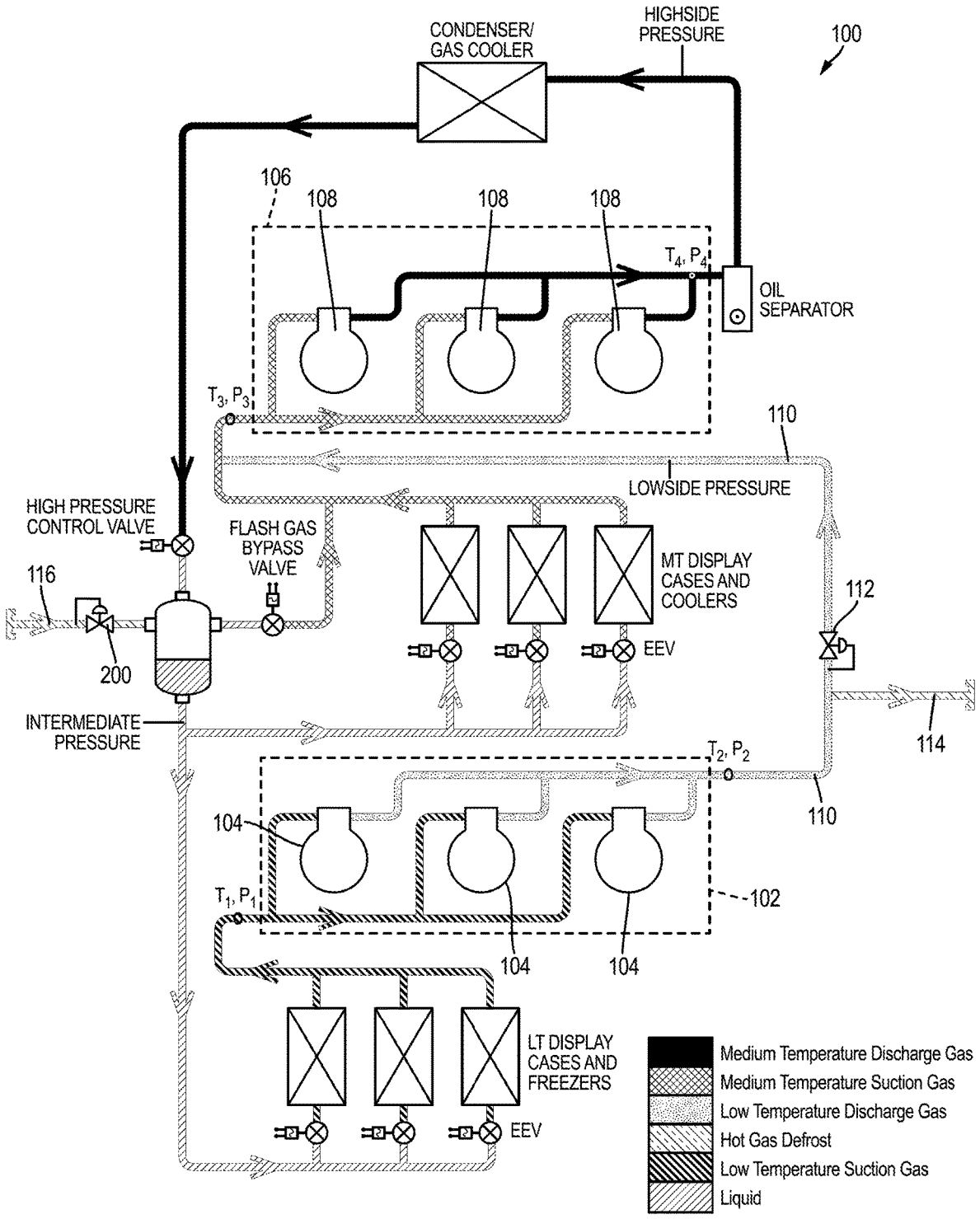
FIG. 2 is a schematic representation of the refrigeration system shown in FIG. 1 according to some embodiments.

FIG. 2 illustrates another implementation of the refrigeration system 100. In this implementation, the refrigeration system 100 further includes a valve (e.g., regulating valve, solenoid valve, ball valve, etc.), shown as a pressure regulator 200, disposed on the defrost outlet conduit 116. The pressure regulator 200 is configured to be selectively opened and closed to control a flow of the refrigerant through the defrost targets being heated by the refrigerant from the defrost inlet conduit 114. For example, by progressively closing the pressure regulator 200, the pressure within the defrost inlet conduit 114 and the defrost outlet conduit 116 is progressively increased and the flow rate of the refrigerant out of the defrost outlet conduit 116 is progressively decreased, thereby facilitating longer exposure of the refrigerant to the defrost targets and providing greater heating to the defrost targets (e.g., to melt the ice disposed thereon, etc.). The pressure regulator 200 and the defrost control valve 112 can be cooperatively controlled to establish a target pressure between the defrost inlet conduit 114 and the defrost outlet conduit 116. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which are being defrosted and the temperature of the refrigerant, facilitating the most rapid melting of the ice from the defrost targets, and making the refrigeration system 100 more desirable. The pressure regulator 200 and/or the defrost control valve 112 can be electronically controlled such that the pressure of the refrigerant between the defrost inlet conduit 114 and the defrost outlet conduit 116 can be easily selected based on operational requirements of the defrost targets.

Figure 3:
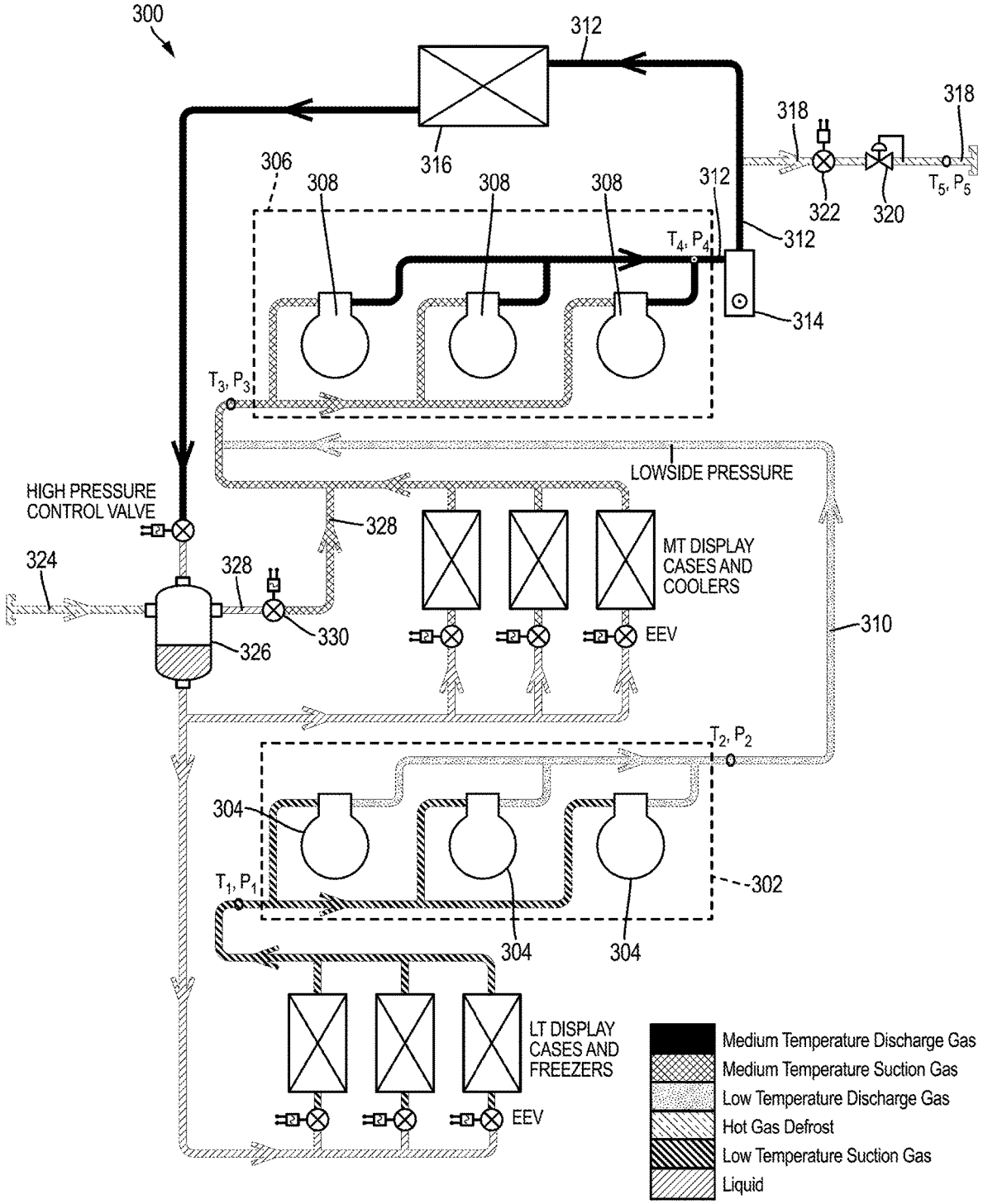
FIG. 3 is a schematic representation of a refrigeration system, according to another exemplary embodiment of the present disclosure.

Referring to FIG. 3, a system (e.g., cooling system, etc.), shown as a refrigeration system 300, is illustrated. The refrigeration system 300 is implemented in at least one refrigerated case for refrigerating goods. For example, the refrigeration system 300 may be implemented in a bank of refrigerated cases, each sharing the refrigeration system 300. As will be explained in more detail herein, the refrigeration system 300 functions to provide or discharge hot gas (e.g., superheated gas, etc.) to a gas defrost system for defrosting components of the at least one refrigerated case, such as components of the refrigeration system 300.

The refrigeration system 300 circulates a refrigerant gas. In various locations within the refrigeration system 300, the gas may become saturated and/or phase shift partially to liquid. Additionally, the gas may become superheated at various locations within the refrigeration system 300. In various exemplary embodiments described herein, the refrigeration system 300 utilizes $CO_2$ as a refrigerant, which may exist in a liquid and/or gaseous state according to the temperature and pressure conditions throughout the various locations of the refrigeration system 300. In these embodiments, the refrigeration system 300 may be termed a "$CO_2$ refrigeration system." However, in other embodiments the refrigeration system 300 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 300 includes a first compressor system, shown as a low temperature compressor system 302. The low temperature compressor system 302 includes a plurality of compressors, shown as low temperature compressors 304. The low temperature compressor system 302 may include one, two, three, four, or more low temperature compressors 304. The low temperature compressors 304 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 300 includes a second compressor system, shown as a medium temperature compressor system 306. The medium temperature compressor system 306 includes a plurality of compressors, shown as medium temperature compressors 308. The medium temperature compressor system 306 may include one, two, three, four, or more medium temperature compressors 308. The medium temperature compressors 308 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 306 is configured to receive gas from the low temperature compressor system 302 via a conduit (e.g., line, pipe, etc.), shown as a conduit 310. The conduit 310 is coupled to an outlet of the low temperature compressor system 302 and an inlet of the medium temperature compressor system 306. Unlike the refrigeration system 100, the refrigeration system 300 does not include a valve along the conduit 310 between the low temperature compressor system 302 and the medium temperature compressor system 306.

Downstream of the medium temperature compressor system 306 is a conduit, shown as a conduit 312. The conduit 312 couples the medium temperature compressor system 306 to a separator (e.g., can, canister, etc.), shown as an oil separator 314. The oil separator 314 is configured to separate oil from the refrigerant that is provided from the medium temperature compressor system 306 prior to the refrigerant being provided to a condenser (e.g., gas cooler, heat exchanger, etc.), shown as a condenser 316.

The refrigeration system 300 also includes a conduit, shown as a defrost inlet conduit 318. The defrost inlet conduit 318 is coupled to the conduit 312 downstream of the oil separator 314 and upstream of the condenser 316. Unlike the refrigeration system 100, the refrigeration system 300 is configured such that the defrost inlet conduit 318 receives refrigerant after it has been compressed by the medium temperature compressor system 306.

The flow of the gas through the defrost inlet conduit 318 is controlled by a valve (e.g., regulating valve, solenoid valve, ball valve, etc.), shown as a pressure reducing valve 320. The pressure reducing valve 320 effectively divides the defrost inlet conduit 318 into two conduits (e.g., portions, etc.). The pressure reducing valve 320 may be manually controlled or electronically controlled by a central controller (e.g., computer system, etc.). The pressure reducing valve 320 may include a controller (e.g., processing circuit, memory, control module, etc.) or may be communicable with a controller (e.g., central controller, etc.) configured to control the pressure reducing valve 320.

The defrost inlet conduit 318 provides refrigerant to defrost targets, such as display cases and evaporators, to be defrosted. The pressure reducing valve 320 is configured to regulate a fifth temperature $T_5$ and/or a fifth pressure $P_5$ of the refrigerant downstream of the pressure reducing valve 320 prior to the refrigerant being provided to the defrost targets. In this way, a pressure and/or flow rate of the refrigerant being provided to the defrost targets can be controlled by the pressure reducing valve 320. For example, by progressively closing the pressure reducing valve 320, the fifth pressure $P_5$ is progressively increased.

The refrigeration system 300 also includes an isolation valve 322 disposed on the defrost inlet conduit 318. In an exemplary embodiment, the isolation valve 322 is disposed upstream of the pressure reducing valve 320. The isolation valve 322 is configured to selectively isolate the portion of the defrost inlet conduit 318 that is downstream of the isolation valve 322, and therefore the defrost targets, from the portion of the defrost inlet conduit 318 that is upstream of the isolation valve 322, and therefore the conduit 312. In various embodiments, the isolation valve 322 is configured to perform such an isolation in response to determining that a pressure, such as the fifth pressure $P_5$, is above a threshold.

After flowing from the defrost inlet conduit 318 through the defrost targets to be defrosted, the refrigerant is directed through a defrost outlet conduit 324. The defrost outlet conduit 324 provides the refrigerant to a reservoir, shown as a flash tank 326. The flash tank 326 is configured to also receive the refrigerant from the condenser 316. The flash tank 326 provides the refrigerant to a conduit, shown as a vent conduit 328. The vent conduit 328 is fluidly coupled to the conduit 310 and may provide the refrigerant to the medium temperature compressor system 306.

The refrigeration system 300 also includes a valve (e.g., regulating valve, solenoid valve, ball valve, etc.), shown as a vent valve 330 disposed on the vent conduit 328. The vent valve 330 is configured to selectively vent refrigerant from the flash tank 326 through the vent conduit 328 to the medium temperature compressor system 306. For example, the vent valve 330 may be controlled to vent refrigerant from the flash tank 326 to the medium temperature compressor system 306 when the fifth pressure $P_5$, or the pressure at another point within the defrost system (e.g., along and between the defrost inlet conduit 318 and the defrost outlet conduit 324, etc.) exceeds a threshold.

In various embodiments, the pressure of the refrigerant in the defrost outlet conduit 324, the defrost targets, and the defrost inlet conduit 318 can be varied by adjusting the pressure of the refrigerant in the flash tank 326. The pressure of the refrigerant in the flash tank 326 can be adjusted changing the threshold at which the vent valve 330 opens. For example, while the refrigerant is flowing through the defrost targets, the fifth pressure $P_5$ may exceed a previously set threshold but the vent valve 330 is controlled to remain closed so as to cause the pressure of the refrigerant between the defrost inlet conduit 318 and the defrost outlet conduit 324 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 300 more desirable. The vent valve 330 can be electronically controlled such that the pressure of the refrigerant between the defrost inlet conduit 318 and the defrost outlet conduit 324 can be easily selected based on the defrost targets.

Figure 4:
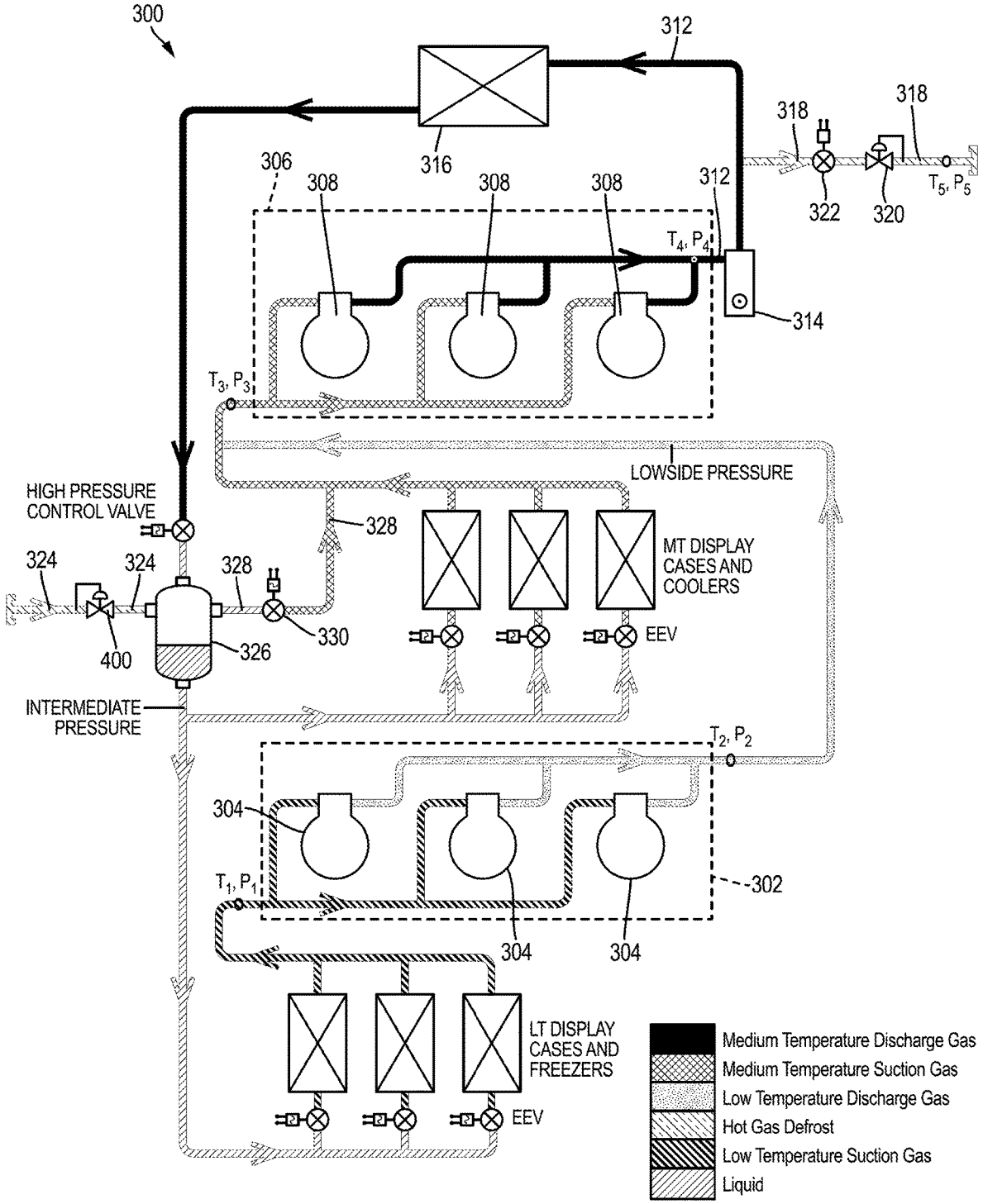
FIG. 4 is a schematic representation of the refrigeration system shown in FIG. 3 according to some embodiments.

FIG. 4 illustrates another implementation of the refrigeration system 300. In this implementation, the refrigeration system 300 further includes a valve (e.g., regulating valve, solenoid valve, ball valve, etc.), shown as a pressure regulator 400, disposed on the defrost outlet conduit 324. The pressure regulator 400 is configured to be selectively opened and closed to control a flow of the refrigerant through the defrost targets being heated by the refrigerant from the defrost inlet conduit 318 and into the flash tank 326. For example, by progressively closing the pressure regulator 400, the pressure within the defrost inlet conduit 318 and the defrost outlet conduit 324 is progressively increased and the flow rate of the refrigerant out of the defrost outlet conduit 324 and into the flash tank 326 is progressively decreased, thereby facilitating longer exposure of the refrigerant to the defrost targets and providing greater heating to the defrost targets (e.g., to melt the ice disposed thereon, etc.). The pressure regulator 400 and the pressure reducing valve 320 can be cooperatively controlled to establish a target pressure therebetween. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 300 more desirable. The pressure regulator 400 and/or the pressure reducing valve 320 can be electronically controlled such that the pressure of the refrigerant therebetween can be easily selected based on the defrost targets.

Figure 5:
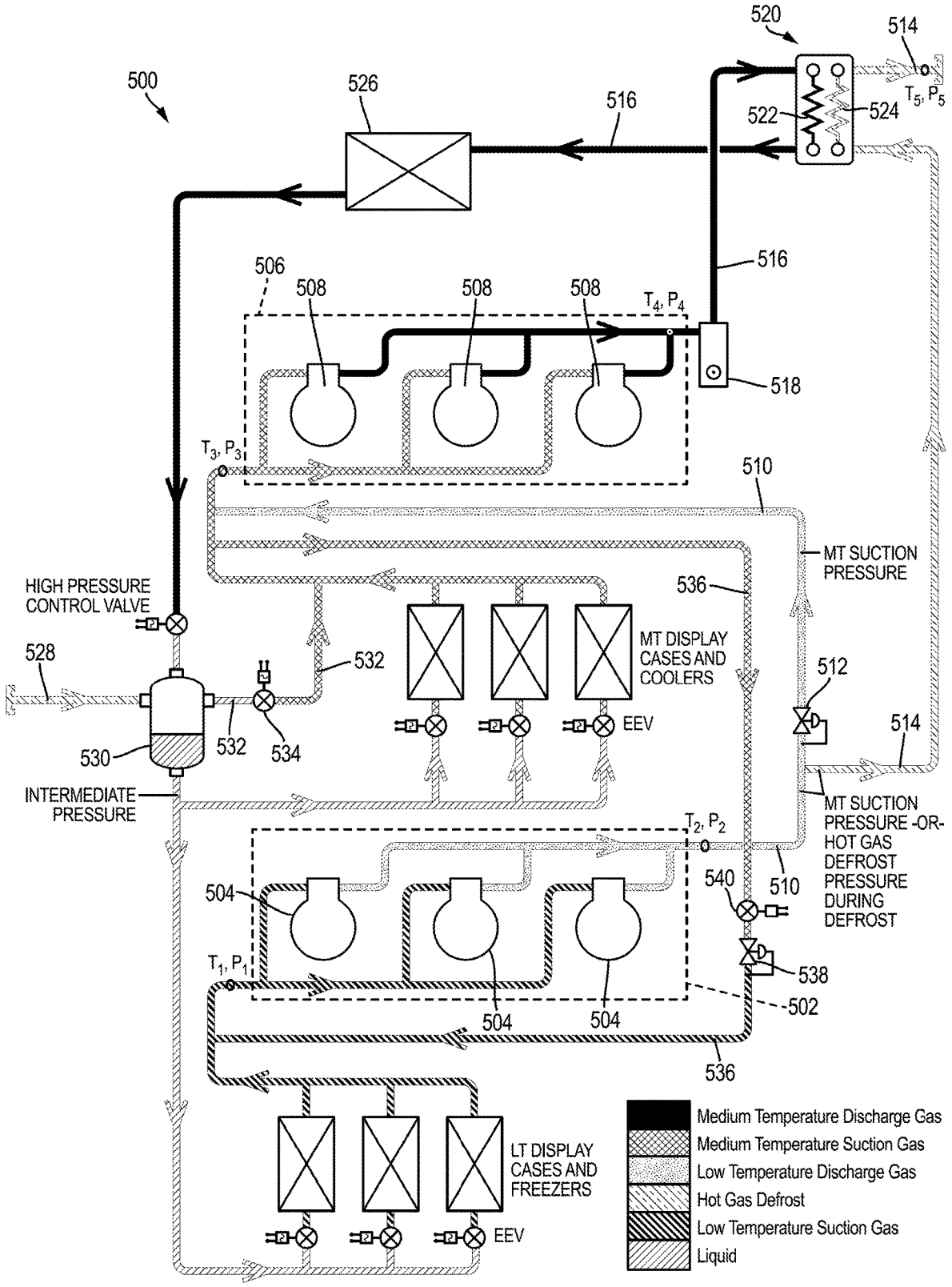
FIG. 5 is a schematic representation of a refrigeration system, according to yet another exemplary embodiment of the present disclosure.

Referring to FIG. 5, a system (e.g., cooling system, etc.), shown as a refrigeration system 500, is illustrated. The refrigeration system 500 is implemented in at least one refrigerated case for refrigerating goods. For example, the refrigeration system 500 may be implemented in a bank of refrigerated cases, each sharing the refrigeration system 500. As will be explained in more detail herein, the refrigeration system 500 functions to provide or discharge hot gas (e.g., superheated gas, etc.) to a gas defrost system for defrosting components of the at least one refrigerated case, such as components of the refrigeration system 500.

The refrigeration system 500 circulates a refrigerant gas. In various locations within the refrigeration system 500, the gas may become saturated and/or phase shift partially to liquid. Additionally, the gas may become superheated at various locations within the refrigeration system 500. In various exemplary embodiments described herein, the refrigeration system 500 utilizes $CO_2$ as a refrigerant, which may exist in a liquid and/or gaseous state according to the temperature and pressure conditions throughout the various locations of the refrigeration system 500. In these embodiments, the refrigeration system 500 may be termed a "$CO_2$ refrigeration system." However, in other embodiments the refrigeration system 500 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 500 includes a first compressor system, shown as a low temperature compressor system 502. The low temperature compressor system 502 includes a plurality of compressors, shown as low temperature compressors 504. The low temperature compressor system 502 may include one, two, three, four, or more low temperature compressors 504. The low temperature compressors 504 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 500 includes a second compressor system, shown as a medium temperature compressor system 506. The medium temperature compressor system 506 includes a plurality of compressors, shown as medium temperature compressors 508. The medium temperature compressor system 506 may include one, two, three, four, or more medium temperature compressors 508. The medium temperature compressors 508 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 506 is configured to receive gas from the low temperature compressor system 502 via a conduit (e.g., line, pipe, etc.), shown as a conduit 510. The conduit 510 is coupled to an outlet of the low temperature compressor system 502 and an inlet of the medium temperature compressor system 506.

The flow of the gas from the low temperature compressor system 502 to the medium temperature compressor system 506 through the conduit 510 is controlled by a valve (e.g., regulating valve, solenoid valve, ball valve, etc.), shown as a defrost control valve 512. The defrost control valve 512 is disposed along (e.g., positioned on, etc.) the conduit 510. The defrost control valve 512 effectively divides the conduit 510 into two conduits (e.g., portions, etc.). The defrost control valve 512 may be manually controlled or electronically controlled by a central controller (e.g., computer system, etc.). The defrost control valve 512 may include a controller (e.g., processing circuit, memory, control module, etc.) or may be communicable with a controller (e.g., central controller, etc.) configured to control the defrost control valve 512.

The defrost control valve 512 is positioned upstream of a conduit, shown as a defrost inlet conduit 514. The defrost inlet conduit 514 provides refrigerant to defrost targets, such as display cases and evaporators, to be defrosted. By controlling the defrost control valve 512 (e.g., progressively opening the defrost control valve, 512, progressively closing the defrost control valve 512, etc.) more or less gas may be provided or discharged from the low temperature compressor system 502 to the medium temperature compressor system 506 thereby causing more or less gas to be provided from the low temperature compressor system 502 to the defrost inlet conduit 514. When the defrost control valve 512 is closed, the pressure $P_2$ upstream of the defrost control valve 512 increases and additional refrigerant is provided to the defrost inlet conduit 514.

Downstream of the medium temperature compressor system 506 is a conduit, shown as a heat exchange conduit 516. The heat exchange conduit 516 couples the medium temperature compressor system 506 to a separator (e.g., can, canister, etc.), shown as an oil separator 518. The oil separator 518 is configured to separate oil from the refrigerant that is provided from the medium temperature compressor system 506.

The refrigeration system 500 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 520. The defrost heat exchanger 520 includes a first circuit, shown as a first circuit 522, and a second circuit, shown as a second circuit 524. The first circuit 522 is positioned along the heat exchange conduit 516 such that the first circuit 522 receives the refrigerant from the oil separator 518. The second circuit 524 is positioned along the defrost inlet conduit 514 such that the second circuit 524 receives the refrigerant from the low temperature compressor system 502.

Due to the additional compression of the refrigerant provided by the medium temperature compressor system 506, the fourth temperature $T_4$ is greater than the second temperature $T_2$. As a result of this temperature difference, the defrost heat exchanger 520 is configured to transfer heat from the refrigerant in the first circuit 522 to the refrigerant in the second circuit 524, such that the refrigerant has a fifth temperature $T_5$ greater than the second temperature $T_2$ prior to the refrigerant being provided to the defrost targets. This refrigerant also has a fifth pressure $P_5$. In this way, the refrigerant that is provided to the defrost targets, such as display cases and evaporators, to be defrosted is provided with additional heat. This additional heat may cause the refrigerant to become superheated.

The refrigeration system 500 also includes a condenser (e.g., gas cooler, heat exchanger, etc.), shown as a condenser 526. The condenser 526 is configured to receive the refrigerant from the heat exchange conduit 516 downstream of the first circuit 522.

After flowing from the defrost inlet conduit 514 through the defrost targets to be defrosted, the refrigerant is directed through a defrost outlet conduit 528. The defrost outlet conduit 528 provides the refrigerant to a reservoir, shown as a flash tank 530. The flash tank 530 is configured to also receive the refrigerant from the condenser 526. The flash tank 530 provides the refrigerant to a conduit, shown as a vent conduit 532. The vent conduit 532 is fluidly coupled to the conduit 510 and may provide the refrigerant to the medium temperature compressor system 506.

The refrigeration system 500 also includes a valve (e.g., regulating valve, solenoid valve, ball valve, etc.), shown as a vent valve 534 disposed on the vent conduit 532. The vent valve 534 is configured to selectively vent refrigerant from the flash tank 530 through the vent conduit 532 to the medium temperature compressor system 506. For example, the vent valve 534 may be controlled to vent refrigerant from the flash tank 530 to the medium temperature compressor system 506 when the fifth pressure $P_5$, or the pressure at another point within the defrost system (e.g., along and between the defrost inlet conduit 514 and the defrost outlet conduit 528, etc.) exceeds a threshold.

In various embodiments, the pressure of the refrigerant in the defrost outlet conduit 528, the defrost targets, and the defrost inlet conduit 514 can be varied by adjusting the pressure of the refrigerant in the flash tank 530. The pressure of the refrigerant in the flash tank 530 can be adjusted changing the threshold at which the vent valve 534 opens. For example, while the refrigerant is flowing through the defrost targets, the fifth pressure $P_5$ may exceed a previously set threshold but the vent valve 534 is controlled to remain closed so as to cause the pressure of the refrigerant between the defrost inlet conduit 514 and the defrost outlet conduit 528 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 500 more desirable. The vent valve 534 can be electronically controlled such that the pressure of the refrigerant between the defrost inlet conduit 514 and the defrost outlet conduit 528 can be easily selected based on the defrost targets.

The refrigeration system 500 also includes a conduit, shown as a return conduit 536. The return conduit 536 is coupled to the conduit 510, downstream of the defrost control valve 512 and upstream of the medium temperature compressor system 506, and to an inlet of the low temperature compressor system 502. The return conduit 536 is configured to selectively provide refrigerant from an inlet of the medium temperature compressor system 506 to an inlet of the low temperature compressor system 502.

The refrigeration system 500 may also include a valve (e.g., regulating valve, solenoid valve, ball valve, etc.), shown as a return control valve 538, disposed on the return conduit 536. The return control valve 538 is configured to be selectively opened and closed to control a flow of the refrigerant through the return conduit 536. When refrigerant is provided from the return conduit 536 to the inlet of the low temperature compressor system 502, the refrigerant creates a "false load" on the low temperature compressor system 502, thereby causing additional refrigerant to be provided to the low temperature compressor system 502 and therefore to the defrost inlet conduit 514.

The refrigeration system 500 may also include a valve (e.g., regulating valve, solenoid valve, ball valve, etc.), shown as a return isolation valve 540 disposed on the return conduit 536. In an exemplary embodiment, the return isolation valve 540 is disposed upstream of the return control valve 538. The return isolation valve 540 is configured to selectively isolate the portion of the return conduit 536 that is downstream of the return isolation valve 540, and therefore the low temperature compressor system 502, from the portion of the return conduit 536 that is upstream of the return isolation valve 540, and therefore the medium temperature compressor system 506. In various embodiments, the return isolation valve 540 is configured to perform such an isolation in response to determining that a pressure, such as the fifth pressure $P_1$, is above a threshold.

Figure 6:
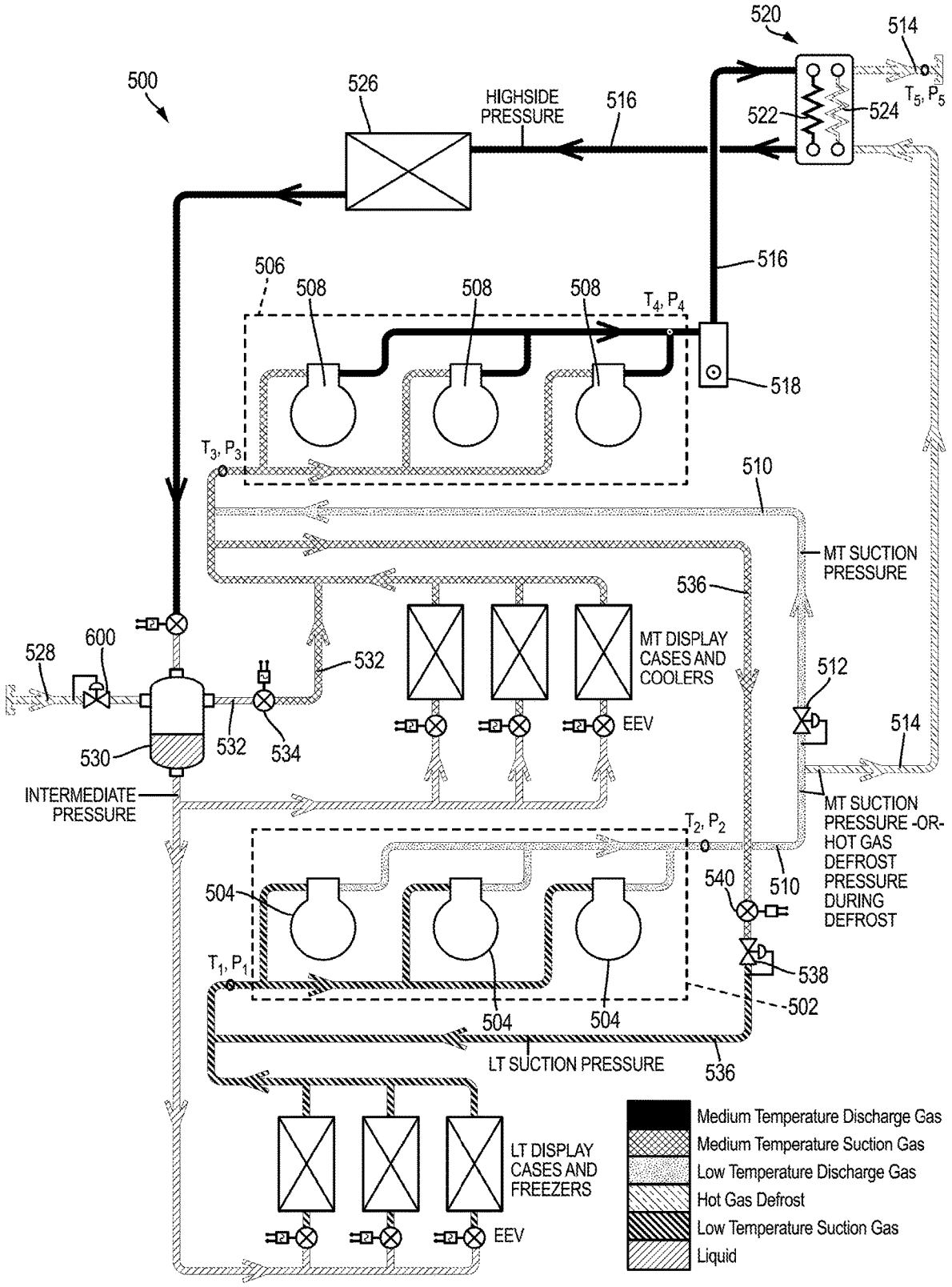
FIG. 6 is a schematic representation of the refrigeration system shown in FIG. 5 according to some embodiments.

FIG. 6 illustrates another implementation of the refrigeration system 500. In this implementation, the refrigeration system 500 further includes a valve (e.g., regulating valve, solenoid valve, ball valve, etc.), shown as a pressure regulator 600, disposed on the defrost outlet conduit 528. The pressure regulator 600 is configured to be selectively opened and closed to control a flow of the refrigerant through the defrost targets being heated by the refrigerant from the defrost inlet conduit 514 and into the flash tank 530. For example, by progressively closing the pressure regulator 600, the pressure within the defrost inlet conduit 514 and the defrost outlet conduit 528 is progressively increased and the flow rate of the refrigerant out of the defrost outlet conduit 528 and into the flash tank 530 is progressively decreased, thereby facilitating longer exposure of the refrigerant to the defrost targets and providing greater heating to the defrost targets (e.g., to melt the ice disposed thereon, etc.). The pressure regulator 600 and the defrost control valve 512 can be cooperatively controlled to establish a target pressure within the defrost system (e.g., along and between the defrost inlet conduit 514 and the defrost outlet conduit 528, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 500 more desirable. The pressure regulator 600 and/or the defrost control valve 512 can be electronically controlled such that the pressure of the refrigerant therebetween can be easily selected based on the defrost targets.

Figure 7:
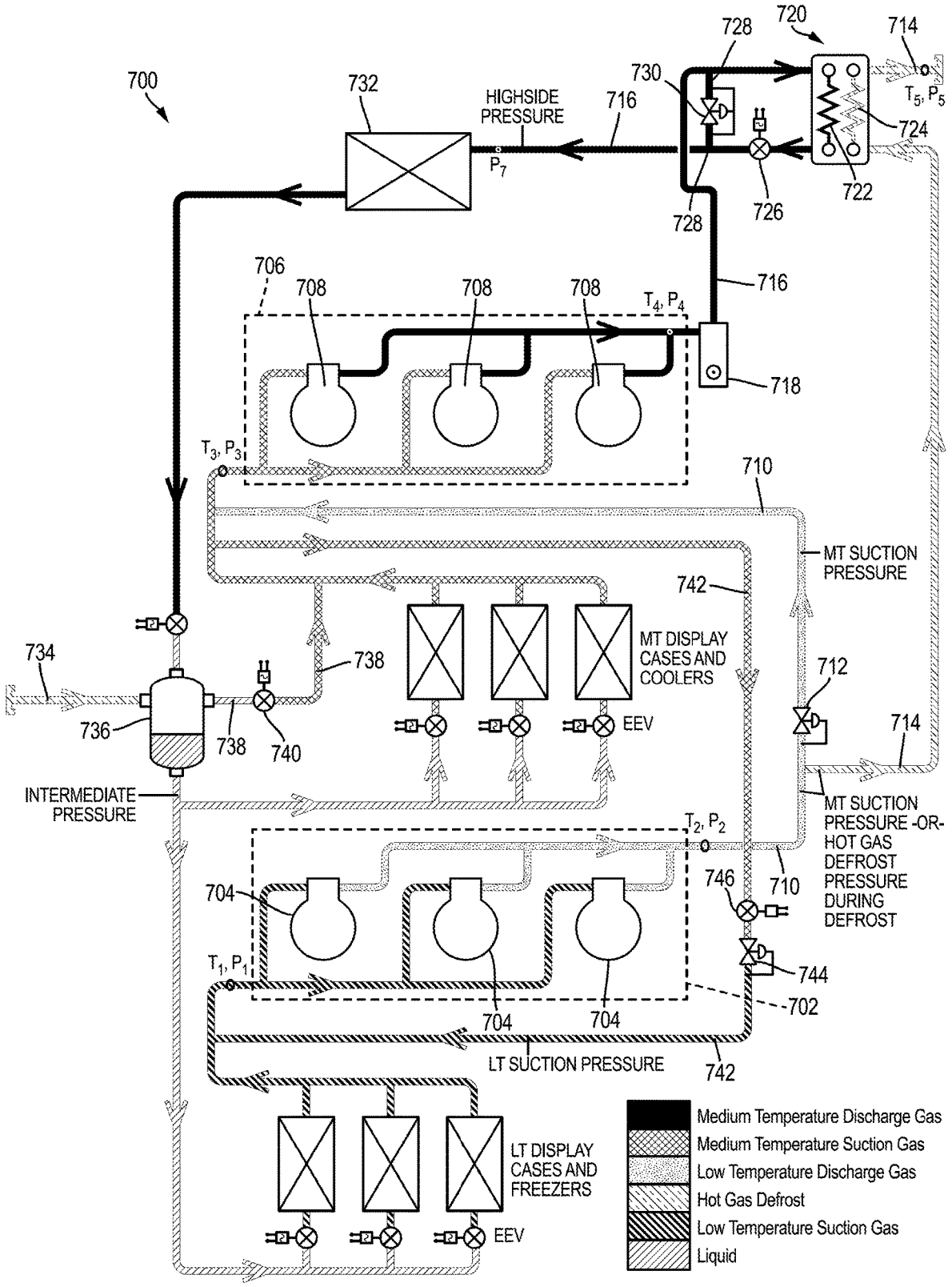
FIG. 7 is a schematic representation of a refrigeration system, according to yet another exemplary embodiment of the present disclosure.

Referring to FIG. 7, a system (e.g., cooling system, etc.), shown as a refrigeration system 700, is illustrated. The refrigeration system 700 is implemented in at least one refrigerated case for refrigerating goods. For example, the refrigeration system 700 may be implemented in a bank of refrigerated cases, each sharing the refrigeration system 700. As will be explained in more detail herein, the refrigeration system 700 functions to provide or discharge hot gas (e.g., superheated gas, etc.) to a gas defrost system for defrosting components of the at least one refrigerated case, such as components of the refrigeration system 700.

The refrigeration system 700 circulates a refrigerant gas. In various locations within the refrigeration system 700, the gas may become saturated and/or phase shift partially to liquid. Additionally, the gas may become superheated at various locations within the refrigeration system 700. In various exemplary embodiments described herein, the refrigeration system 700 utilizes $CO_2$ as a refrigerant, which may exist in a liquid and/or gaseous state according to the temperature and pressure conditions throughout the various locations of the refrigeration system 700. In these embodiments, the refrigeration system 700 may be termed a "$CO_2$ refrigeration system." However, in other embodiments the refrigeration system 700 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 700 includes a first compressor system, shown as a low temperature compressor system 702. The low temperature compressor system 702 includes a plurality of compressors, shown as low temperature compressors 704. The low temperature compressor system 702 may include one, two, three, four, or more low temperature compressors 704. The low temperature compressors 704 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 700 includes a second compressor system, shown as a medium temperature compressor system 706. The medium temperature compressor system 706 includes a plurality of compressors, shown as medium temperature compressors 708. The medium temperature compressor system 706 may include one, two, three, four, or more medium temperature compressors 708. The medium temperature compressors 708 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 706 is configured to receive gas from the low temperature compressor system 702 via a conduit (e.g., line, pipe, etc.), shown as a conduit 710. The conduit 710 is coupled to an outlet of the low temperature compressor system 702 and an inlet of the medium temperature compressor system 706.

The flow of the gas from the low temperature compressor system 702 to the medium temperature compressor system 706 through the conduit 710 is controlled by a valve (e.g., regulating valve, solenoid valve, ball valve, etc.), shown as a defrost control valve 712. The defrost control valve 712 is disposed along (e.g., positioned on, etc.) the conduit 710. The defrost control valve 712 effectively divides the conduit 710 into two conduits (e.g., portions, etc.). The defrost control valve 712 may be manually controlled or electronically controlled by a central controller (e.g., computer system, etc.). The defrost control valve 712 may include a controller (e.g., processing circuit, memory, control module, etc.) or may be communicable with a controller (e.g., central controller, etc.) configured to control the defrost control valve 712.

The defrost control valve 712 is positioned upstream of a conduit, shown as a defrost inlet conduit 714. The defrost inlet conduit 714 provides refrigerant to defrost targets, such as display cases and evaporators, to be defrosted. By controlling the defrost control valve 712 (e.g., progressively opening the defrost control valve, 712, progressively closing the defrost control valve 712, etc.) more or less gas may be provided or discharged from the low temperature compressor system 702 to the medium temperature compressor system 706 thereby causing more or less gas to be provided from the low temperature compressor system 702 to the defrost inlet conduit 714. When the defrost control valve 712 is closed, the pressure $P_2$ upstream of the defrost control valve 712 increases and additional refrigerant is provided to the defrost inlet conduit 714.

Downstream of the medium temperature compressor system 706 is a conduit, shown as a heat exchange conduit 716. The heat exchange conduit 716 couples the medium temperature compressor system 706 to a separator (e.g., can, canister, etc.), shown as an oil separator 718. The oil separator 718 is configured to separate oil from the refrigerant that is provided from the medium temperature compressor system 706.

The refrigeration system 700 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 720. The defrost heat exchanger 720 includes a first circuit, shown as a first circuit 722, and a second circuit, shown as a second circuit 724. The first circuit 722 is positioned along the heat exchange conduit 716 such that the first circuit 722 receives the refrigerant from the oil separator 718. The second circuit 724 is positioned along the defrost inlet conduit 714 such that the second circuit 724 receives the refrigerant from the low temperature compressor system 702.

Due to the additional compression of the refrigerant provided by the medium temperature compressor system 706, the fourth temperature $T_4$ is greater than the second temperature $T_2$. As a result of this temperature difference, the defrost heat exchanger 720 is configured to transfer heat from the refrigerant in the first circuit 722 to the refrigerant in the second circuit 724, such that the refrigerant has a fifth temperature $T_5$ greater than the second temperature $T_2$ prior to the refrigerant being provided to the defrost targets. This refrigerant also has a fifth pressure $P_5$. In this way, the refrigerant that is provided to the defrost targets, such as display cases and evaporators, to be defrosted is provided with additional heat. This additional heat may cause the refrigerant to become superheated.

The refrigeration system 700 also includes a valve (e.g., regulating valve, solenoid valve, ball valve, etc.), shown as a defrost control valve 726. The defrost control valve 726 is positioned along the heat exchange conduit 716 downstream of an outlet of the first circuit 722. The defrost control valve 726 is configured to be selectively opened and closed to control the flow of the refrigerant through the first circuit 722, and therefore the rate of heat exchange between the first circuit 722 and the second circuit 724, such that the fifth temperature $T_5$ is at or below a target temperature associated with providing desirable cooling to the defrost targets receiving refrigerant from the defrost inlet conduit 714. By progressively closing the defrost control valve 726, the flow of the refrigerant from the medium temperature compressor system 706 is slowed and the pressure of the refrigerant in the heat exchange conduit 716 upstream of the defrost control valve 726, such as the fourth pressure $P_4$, increases, thereby increasing the temperature of the refrigerant in the heat exchange conduit 716 upstream of the defrost control valve 726, such as the fourth temperature $T_4$.

The refrigeration system 700 also includes a conduit, shown as a bypass conduit 728. The bypass conduit 728 is fluidly coupled to the heat exchange conduit 716 at a first location upstream of the first circuit 722 and at a second location downstream of the first circuit 722 to establish a fluid pathway through which refrigerant may bypass the first circuit 722. The refrigeration system 700 also includes a valve (e.g., regulating valve, solenoid valve, ball valve, etc.), shown as a bypass pressure regulator 730. The bypass pressure regulator 730 is positioned along the bypass conduit 728 and configured to control the flow of refrigerant therethrough. The refrigeration system 700 also includes a condenser (e.g., gas cooler, heat exchanger, etc.), shown as a condenser 732. The condenser 732 is configured to receive the refrigerant from the heat exchange conduit 716 downstream of the first circuit 722 and the defrost control valve 726.

In various embodiments, the bypass pressure regulator 730 is controlled to maintain a maximum differential pressure between the fourth pressure $P_4$ and a seventh pressure $P_7$, upstream of the condenser 732 and downstream of both the bypass pressure regulator 730 and the defrost control valve 726. For example, the bypass pressure regulator 730 may be closed initially and then the defrost control valve 726 may be independently opened to increase the fifth temperature $T_5$ or closed to decrease the fifth temperature $T_5$. As the defrost control valve 726 closes, the fourth pressure $P_4$ increases, thereby causing an increase in the differential pressure between the fourth pressure $P_4$ and the seventh pressure $P_7$. Once the differential pressure between the fourth pressure $P_4$ and the seventh pressure $P_7$ is equal to the maximum pressure differential, the bypass pressure regulator 730 opens, thereby decreasing the differential pressure between the fourth pressure $P_4$ and the seventh pressure $P_7$.

In other embodiments, by controlling the bypass pressure regulator 730, the fourth pressure $P_4$ of the refrigerant can be increased to provide for a fourth temperature $T_4$ that facilitates cooling within the defrost heat exchanger 720 that causes the fifth temperature $T_5$ to attain a target temperature. The target temperature may be fixed or may be adjusted continuously based on parameters (e.g., temperature, pressure, level of ice deposits, etc.) of the defrost targets.

After flowing from the defrost inlet conduit 714 through the defrost targets to be defrosted, the refrigerant is directed through a defrost outlet conduit 734. The defrost outlet conduit 734 provides the refrigerant to a reservoir, shown as a flash tank 736. The flash tank 736 is configured to also receive the refrigerant from the condenser 732. The flash tank 736 provides the refrigerant to a conduit, shown as a vent conduit 738. The vent conduit 738 is fluidly coupled to the conduit 710 and may provide the refrigerant to the medium temperature compressor system 706.

The refrigeration system 700 also includes a valve (e.g., regulating valve, solenoid valve, ball valve, etc.), shown as a vent valve 740 disposed on the vent conduit 738. The vent valve 740 is configured to selectively vent refrigerant from the flash tank 736 through the vent conduit 738 to the medium temperature compressor system 706. For example, the vent valve 740 may be controlled to vent refrigerant from the flash tank 736 to the medium temperature compressor system 706 when the fifth pressure $P_5$, or the pressure at another point within the defrost system (e.g., along and between the defrost inlet conduit 714 and the defrost outlet conduit 734, etc.) exceeds a threshold.

In various embodiments, the pressure of the refrigerant in the defrost outlet conduit 734, the defrost targets, and the defrost inlet conduit 714 can be varied by adjusting the pressure of the refrigerant in the flash tank 736. The pressure of the refrigerant in the flash tank 736 can be adjusted changing the threshold at which the vent valve 740 opens. For example, while the refrigerant is flowing through the defrost targets, the fifth pressure $P_5$ may exceed a previously set threshold but the vent valve 740 is controlled to remain closed so as to cause the pressure of the refrigerant between the defrost inlet conduit 714 and the defrost outlet conduit 734 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 700 more desirable. The vent valve 740 can be electronically controlled such that the pressure of the refrigerant between the defrost inlet conduit 714 and the defrost outlet conduit 734 can be easily selected based on the defrost targets.

The refrigeration system 700 also includes a conduit, shown as a return conduit 742. The return conduit 742 is coupled to the conduit 710, downstream of the defrost control valve 712 and upstream of the medium temperature compressor system 706, and to an inlet of the low temperature compressor system 702. The return conduit 742 is configured to selectively provide refrigerant from an inlet of the medium temperature compressor system 706 to an inlet of the low temperature compressor system 702.

The refrigeration system 700 may also include a valve (e.g., regulating valve, solenoid valve, ball valve, etc.), shown as a return control valve 744, disposed on the return conduit 742. The return control valve 744 is configured to be selectively opened and closed to control a flow of the refrigerant through the return conduit 742. When refrigerant is provided from the return conduit 742 to the inlet of the low temperature compressor system 702, the refrigerant creates a "false load" on the low temperature compressor system 702, thereby causing additional refrigerant to be provided to the low temperature compressor system 702 and therefore to the defrost inlet conduit 714.

The refrigeration system 700 may also include a valve (e.g., regulating valve, solenoid valve, ball valve, etc.), shown as a return isolation valve 746 disposed on the return conduit 742. In an exemplary embodiment, the return isolation valve 746 is disposed upstream of the return control valve 744. The return isolation valve 746 is configured to selectively isolate the portion of the return conduit 742 that is downstream of the return isolation valve 746, and therefore the low temperature compressor system 702, from the portion of the return conduit 742 that is upstream of the return isolation valve 746, and therefore the medium temperature compressor system 706. In various embodiments, the return isolation valve 746 is configured to perform such an isolation in response to determining that a pressure, such as the first pressure $P_1$, is above a threshold.

Figure 8:
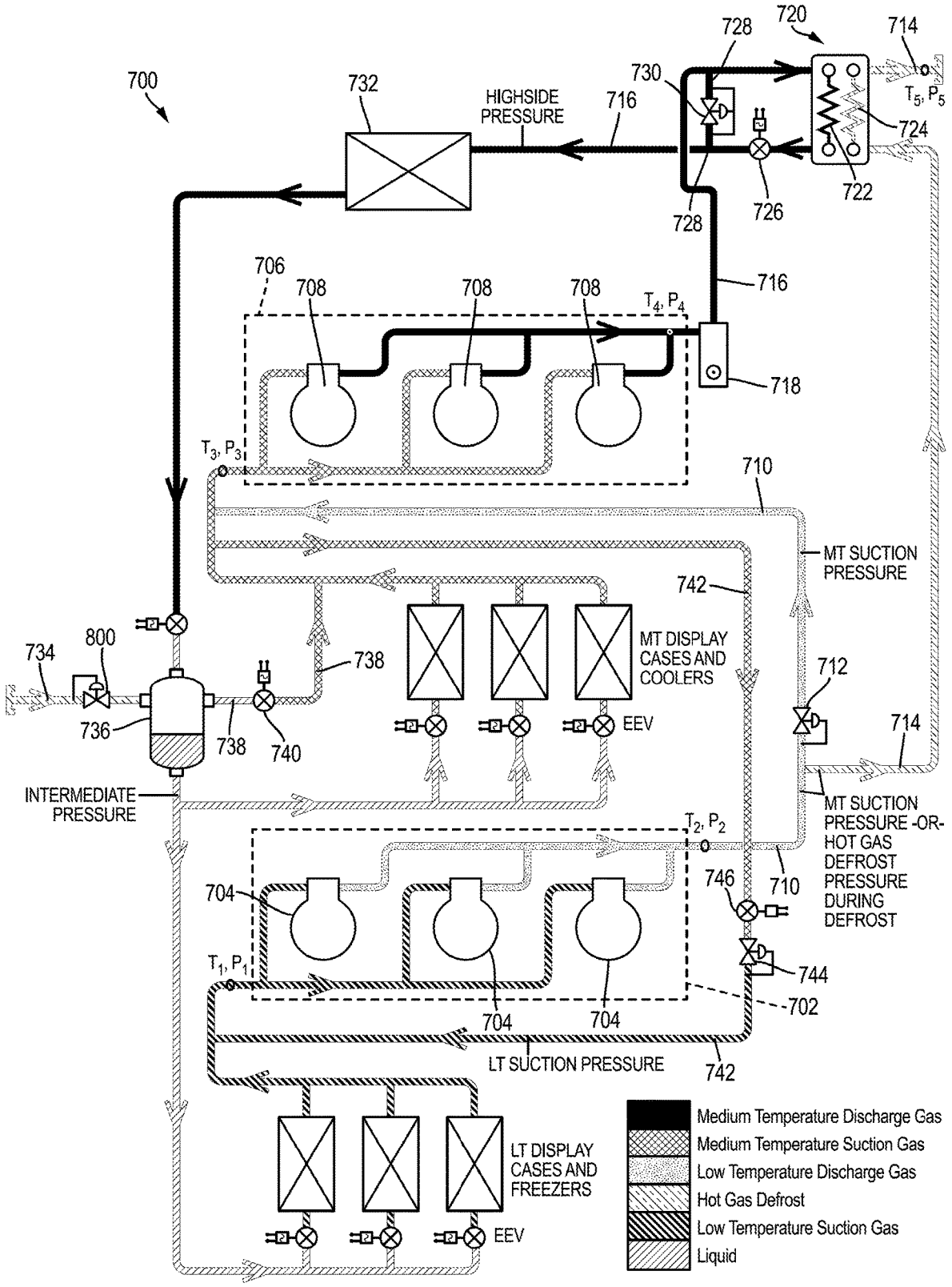
FIG. 8 is a schematic representation of the refrigeration system shown in FIG. 7 according to some embodiments.

FIG. 8 illustrates another implementation of the refrigeration system 700. In this implementation, the refrigeration system 700 further includes a valve (e.g., regulating valve, solenoid valve, ball valve, etc.), shown as a pressure regulator 800, disposed on the defrost outlet conduit 734. The pressure regulator 800 is configured to be selectively opened and closed to control a flow of the refrigerant through the defrost targets being heated by the refrigerant from the defrost inlet conduit 714 and into the flash tank 736. For example, by progressively closing the pressure regulator 800, the pressure within the defrost inlet conduit 714 and the defrost outlet conduit 734 is progressively increased and the flow rate of the refrigerant out of the defrost outlet conduit 734 and into the flash tank 736 is progressively decreased, thereby facilitating longer exposure of the refrigerant to the defrost targets and providing greater heating to the defrost targets (e.g., to melt the ice disposed thereon, etc.). The pressure regulator 800 and the defrost control valve 712 can be cooperatively controlled to establish a target pressure within the defrost system (e.g., along and between the defrost inlet conduit 714 and the defrost outlet conduit 734, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 700 more desirable. The pressure regulator 800 and/or the defrost control valve 712 can be electronically controlled such that the pressure of the refrigerant therebetween can be easily selected based on the defrost targets.

Figure 9:
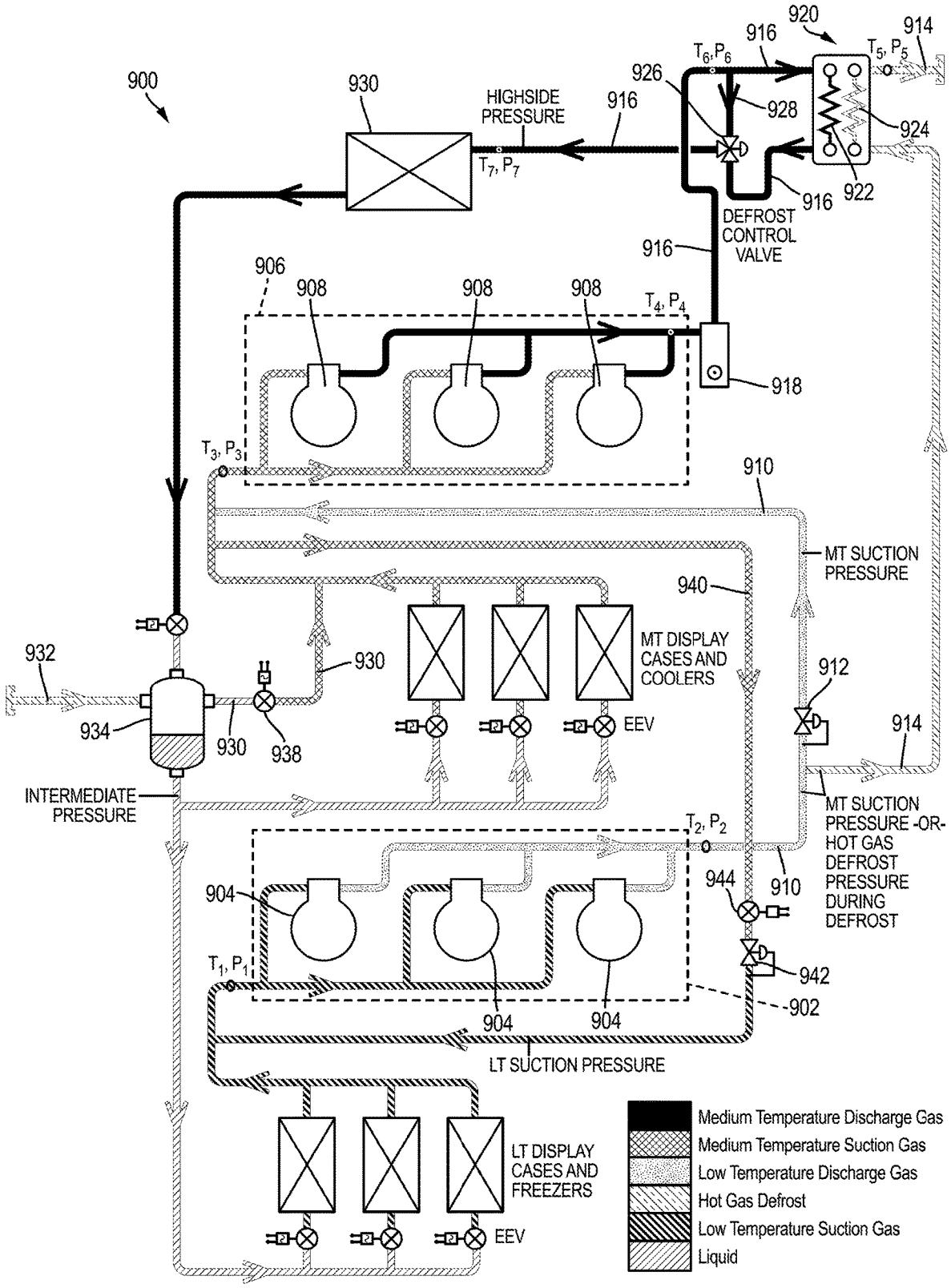
FIG. 9 is a schematic representation of a refrigeration system, according to yet another exemplary embodiment of the present disclosure.

Referring to FIG. 9, a system (e.g., cooling system, etc.), shown as a refrigeration system 900, is illustrated. The refrigeration system 900 is implemented in at least one refrigerated case for refrigerating goods. For example, the refrigeration system 900 may be implemented in a bank of refrigerated cases, each sharing the refrigeration system 900. As will be explained in more detail herein, the refrigeration system 900 functions to provide or discharge hot gas (e.g., superheated gas, etc.) to a gas defrost system for defrosting components of the at least one refrigerated case, such as components of the refrigeration system 900.

The refrigeration system 900 circulates a refrigerant gas. In various locations within the refrigeration system 900, the gas may become saturated and/or phase shift partially to liquid. Additionally, the gas may become superheated at various locations within the refrigeration system 900. In various exemplary embodiments described herein, the refrigeration system 900 utilizes $CO_2$ as a refrigerant, which may exist in a liquid and/or gaseous state according to the temperature and pressure conditions throughout the various locations of the refrigeration system 900. In these embodiments, the refrigeration system 900 may be termed a "$CO_2$ refrigeration system." However, in other embodiments the refrigeration system 900 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 900 includes a first compressor system, shown as a low temperature compressor system 902. The low temperature compressor system 902 includes a plurality of compressors, shown as low temperature compressors 904. The low temperature compressor system 902 may include one, two, three, four, or more low temperature compressors 904. The low temperature compressors 904 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 900 includes a second compressor system, shown as a medium temperature compressor system 906. The medium temperature compressor system 906 includes a plurality of compressors, shown as medium temperature compressors 908. The medium temperature compressor system 906 may include one, two, three, four, or more medium temperature compressors 908. The medium temperature compressors 908 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 906 is configured to receive gas from the low temperature compressor system 902 via a conduit (e.g., line, pipe, etc.), shown as a conduit 910. The conduit 910 is coupled to an outlet of the low temperature compressor system 902 and an inlet of the medium temperature compressor system 906.

The flow of the gas from the low temperature compressor system 902 to the medium temperature compressor system 906 through the conduit 910 is controlled by a valve (e.g., regulating valve, solenoid valve, ball valve, etc.), shown as a defrost control valve 912. The defrost control valve 912 is disposed along (e.g., positioned on, etc.) the conduit 910. The defrost control valve 912 effectively divides the conduit 910 into two conduits (e.g., portions, etc.). The defrost control valve 912 may be manually controlled or electronically controlled by a central controller (e.g., computer system, etc.). The defrost control valve 912 may include a controller (e.g., processing circuit, memory, control module, etc.) or may be communicable with a controller (e.g., central controller, etc.) configured to control the defrost control valve 912.

The defrost control valve 912 is positioned upstream of a conduit, shown as a defrost inlet conduit 914. The defrost inlet conduit 914 provides refrigerant to defrost targets, such as display cases and evaporators, to be defrosted. By controlling the defrost control valve 912 (e.g., progressively opening the defrost control valve, 912, progressively closing the defrost control valve 912, etc.) more or less gas may be provided or discharged from the low temperature compressor system 902 to the medium temperature compressor system 906 thereby causing more or less gas to be provided from the low temperature compressor system 902 to the defrost inlet conduit 914. When the defrost control valve 912 is closed, the pressure $P_2$ upstream of the defrost control valve 912 increases and additional refrigerant is provided to the defrost inlet conduit 914.

Downstream of the medium temperature compressor system 906 is a conduit, shown as a heat exchange conduit 916. The heat exchange conduit 916 couples the medium temperature compressor system 906 to a separator (e.g., can, canister, etc.), shown as an oil separator 918. The oil separator 918 is configured to separate oil from the refrigerant that is provided from the medium temperature compressor system 906.

The refrigeration system 900 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 920. The defrost heat exchanger 920 includes a first circuit, shown as a first circuit 922, and a second circuit, shown as a second circuit 924. The first circuit 922 is positioned along the heat exchange conduit 916 such that the first circuit 922 receives the refrigerant from the oil separator 918. The second circuit 924 is positioned along the defrost inlet conduit 914 such that the second circuit 924 receives the refrigerant from the low temperature compressor system 902.

Due to the additional compression of the refrigerant provided by the medium temperature compressor system 906, the fourth temperature $T_4$ is greater than the second temperature $T_2$. As a result of this temperature difference, the defrost heat exchanger 920 is configured to transfer heat from the refrigerant in the first circuit 922 to the refrigerant in the second circuit 924, such that the refrigerant has a fifth temperature $T_5$ greater than the second temperature $T_2$ prior to the refrigerant being provided to the defrost targets. This refrigerant also has a fifth pressure $P_5$. In this way, the refrigerant that is provided to the defrost targets, such as display cases and evaporators, to be defrosted is provided with additional heat. This additional heat may cause the refrigerant to become superheated.

The refrigeration system 900 also includes a valve (e.g., regulating valve, solenoid valve, ball valve, etc.), shown as a three-way defrost control valve 926, a conduit, shown as a bypass conduit 928, and a condenser (e.g., gas cooler, heat exchanger, etc.), shown as a condenser 930. The condenser 930 is configured to receive the refrigerant from the heat exchange conduit 916 downstream of the three-way defrost control valve 926.

The three-way defrost control valve 926 has a first opening coupled to the heat exchange conduit 916 downstream of the first circuit 922, a second opening coupled to the heat exchange conduit 916 upstream of the condenser 930, and a third opening coupled to the bypass conduit 928 which is further coupled to the heat exchange conduit 916 upstream of the first circuit 922. The three-way defrost control valve 926 is configured to be controlled to regulate flow of the refrigerant through the first circuit 922, and therefore the rate of heat exchange between the first circuit 922 and the second circuit 924, such that the fifth temperature $T_5$ is at or within a target tolerance of a target temperature associated with providing desirable defrost results to the defrost targets receiving refrigerant from the defrost inlet conduit 914. Specifically, the three-way defrost control valve 926 operates (e.g., is modulated, etc.) to create a target fifth temperature $T_5$. The target temperature may be fixed or may be adjusted continuously based on parameters (e.g., temperature, pressure, level of ice deposits, etc.) of the defrost targets. For example, when defrost is not desired, the three-way control valve 926 is positioned such that all of the refrigerant flowing through the heat exchange conduit 916 bypasses the defrost heat exchanger 920.

While not shown in FIG. 9, it is understood that the refrigeration system 900 may also include a bypass pressure regulator, similar to the bypass pressure regulator 730, and/or a three-way defrost control valve, similar to the defrost control valve 726. For example, the refrigeration system 900 may include a bypass pressure regulator disposed on the bypass conduit 928 and a three-way defrost control valve disposed on the heat exchange conduit 916 upstream of the first circuit 922 and downstream of the three-way defrost control valve 926. This bypass pressure regulator may facilitate control of a pressure drop through the refrigeration system 900.

After flowing from the defrost inlet conduit 914 through the defrost targets to be defrosted, the refrigerant is directed through a defrost outlet conduit 932. The defrost outlet conduit 932 provides the refrigerant to a reservoir, shown as a flash tank 934. The flash tank 934 is configured to also receive the refrigerant from the condenser 930. The flash tank 934 provides the refrigerant to a conduit, shown as a vent conduit 936. The vent conduit 936 is fluidly coupled to the conduit 910 and may provide the refrigerant to the medium temperature compressor system 906.

The refrigeration system 900 also includes a valve (e.g., regulating valve, solenoid valve, ball valve, etc.), shown as a vent valve 938 disposed on the vent conduit 936. The vent valve 938 is configured to selectively vent refrigerant from the flash tank 934 through the vent conduit 936 to the medium temperature compressor system 906. For example, the vent valve 938 may be controlled to vent refrigerant from the flash tank 934 to the medium temperature compressor system 906 when the fifth pressure $P_5$, or the pressure at another point within the defrost system (e.g., along and between the defrost inlet conduit 914 and the defrost outlet conduit 932, etc.) exceeds a threshold.

In various embodiments, the pressure of the refrigerant in the defrost outlet conduit 932, the defrost targets, and the defrost inlet conduit 914 can be varied by adjusting the pressure of the refrigerant in the flash tank 934. The pressure of the refrigerant in the flash tank 934 can be adjusted changing the threshold at which the vent valve 938 opens. For example, while the refrigerant is flowing through the defrost targets, the fifth pressure $P_5$ may exceed a previously set threshold but the vent valve 938 is controlled to remain closed so as to cause the pressure of the refrigerant between the defrost inlet conduit 914 and the defrost outlet conduit 932 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 900 more desirable. The vent valve 938 can be electronically controlled such that the pressure of the refrigerant between the defrost inlet conduit 914 and the defrost outlet conduit 932 can be easily selected based on the defrost targets.

The refrigeration system 900 also includes a conduit, shown as a return conduit 940. The return conduit 940 is coupled to the conduit 910, downstream of the defrost control valve 912 and upstream of the medium temperature compressor system 906, and to an inlet of the low temperature compressor system 902. The return conduit 940 is configured to selectively provide refrigerant from an inlet of the medium temperature compressor system 906 to an inlet of the low temperature compressor system 902.

The refrigeration system 900 may also include a valve (e.g., regulating valve, solenoid valve, ball valve, etc.), shown as a return control valve 942, disposed on the return conduit 940. The return control valve 942 is configured to be selectively opened and closed to control a flow of the refrigerant through the return conduit 940. When refrigerant is provided from the return conduit 940 to the inlet of the low temperature compressor system 902, the refrigerant creates a "false load" on the low temperature compressor system 902, thereby causing additional refrigerant to be provided to the low temperature compressor system 902 and therefore to the defrost inlet conduit 914.

The refrigeration system 900 may also include a valve (e.g., regulating valve, solenoid valve, ball valve, etc.), shown as a return isolation valve 944 disposed on the return conduit 940. In an exemplary embodiment, the return isolation valve 944 is disposed upstream of the return control valve 942. The return isolation valve 944 is configured to selectively isolate the portion of the return conduit 940 that is downstream of the return isolation valve 944, and therefore the low temperature compressor system 902, from the portion of the return conduit 940 that is upstream of the return isolation valve 944, and therefore the medium temperature compressor system 906. In various embodiments, the return isolation valve 944 is configured to perform such an isolation in response to determining that a pressure, such as the first pressure $P_1$, is above a threshold.

Figure 10:
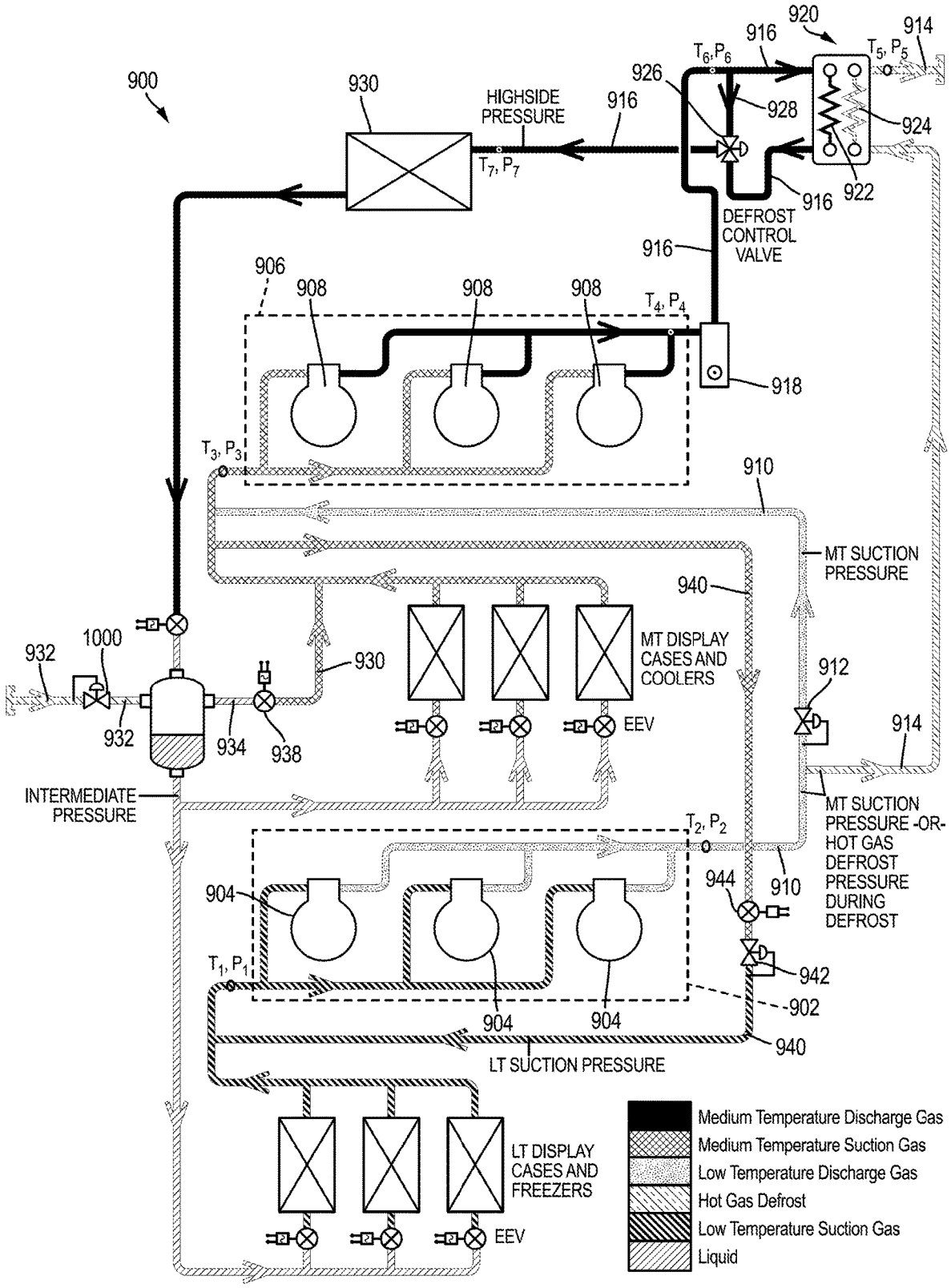
FIG. 10 is a schematic representation of the refrigeration system shown in FIG. 9 according to some embodiments.

FIG. 10 illustrates another implementation of the refrigeration system 900. In this implementation, the refrigeration system 900 further includes a valve (e.g., regulating valve, solenoid valve, ball valve, etc.), shown as a pressure regulator 1000, disposed on the defrost outlet conduit 932. The pressure regulator 1000 is configured to be selectively opened and closed to control a flow of the refrigerant through the defrost targets being heated by the refrigerant from the defrost inlet conduit 914 and into the flash tank 934. For example, by progressively closing the pressure regulator 1000, the pressure within the defrost inlet conduit 914 and the defrost outlet conduit 932 is progressively increased and the flow rate of the refrigerant out of the defrost outlet conduit 932 and into the flash tank 934 is progressively decreased, thereby facilitating longer exposure of the refrigerant to the defrost targets and providing greater heating to the defrost targets (e.g., to melt the ice disposed thereon, etc.). The pressure regulator 1000 and the defrost control valve 912 can be cooperatively controlled to establish a target pressure within the defrost system (e.g., along and between the defrost inlet conduit 914 and the defrost outlet conduit 932, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 900 more desirable. The pressure regulator 1000 and/or the defrost control valve 912 can be electronically controlled such that the pressure of the refrigerant therebetween can be easily selected based on the defrost targets.

Figure 11:
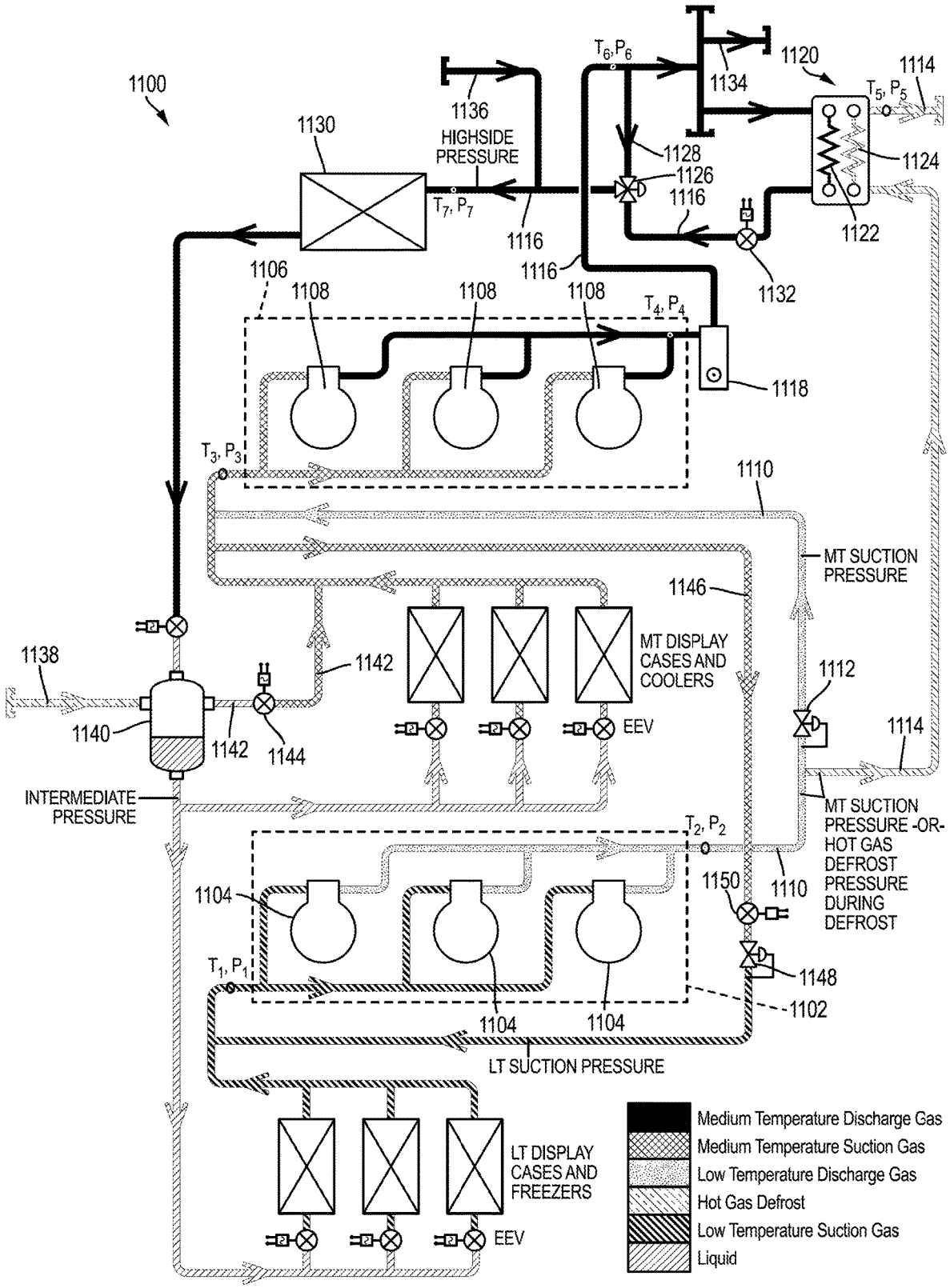
FIG. 11 is a schematic representation of a refrigeration system, according to yet another exemplary embodiment of the present disclosure.

Referring to FIG. 11, a system (e.g., cooling system, etc.), shown as a refrigeration system 1100, is illustrated. The refrigeration system 1100 is implemented in at least one refrigerated case for refrigerating goods. For example, the refrigeration system 1100 may be implemented in a bank of refrigerated cases, each sharing the refrigeration system 1100. As will be explained in more detail herein, the refrigeration system 1100 functions to provide or discharge hot gas (e.g., superheated gas, etc.) to a gas defrost system for defrosting components of the at least one refrigerated case, such as components of the refrigeration system 1100.

The refrigeration system 1100 circulates a refrigerant gas. In various locations within the refrigeration system 1100, the gas may become saturated and/or phase shift partially to liquid. Additionally, the gas may become superheated at various locations within the refrigeration system 1100. In various exemplary embodiments described herein, the refrigeration system 1100 utilizes $CO_2$ as a refrigerant, which may exist in a liquid and/or gaseous state according to the temperature and pressure conditions throughout the various locations of the refrigeration system 1100. In these embodiments, the refrigeration system 1100 may be termed a "$CO_2$ refrigeration system." However, in other embodiments the refrigeration system 1100 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 1100 includes a first compressor system, shown as a low temperature compressor system 1102. The low temperature compressor system 1102 includes a plurality of compressors, shown as low temperature compressors 1104. The low temperature compressor system 1102 may include one, two, three, four, or more low temperature compressors 1104. The low temperature compressors 1104 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 1100 includes a second compressor system, shown as a medium temperature compressor system 1106. The medium temperature compressor system 1106 includes a plurality of compressors, shown as medium temperature compressors 1108. The medium temperature compressor system 1106 may include one, two, three, four, or more medium temperature compressors 1108. The medium temperature compressors 1108 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 1106 is configured to receive gas from the low temperature compressor system 1102 via a conduit (e.g., line, pipe, etc.), shown as a conduit 1110. The conduit 1110 is coupled to an outlet of the low temperature compressor system 1102 and an inlet of the medium temperature compressor system 1106.

The flow of the gas from the low temperature compressor system 1102 to the medium temperature compressor system 1106 through the conduit 1110 is controlled by a valve (e.g., regulating valve, solenoid valve, ball valve, etc.), shown as a defrost control valve 1112. The defrost control valve 1112 is disposed along (e.g., positioned on, etc.) the conduit 1110. The defrost control valve 1112 effectively divides the conduit 1110 into two conduits (e.g., portions, etc.). The defrost control valve 1112 may be manually controlled or electronically controlled by a central controller (e.g., computer system, etc.). The defrost control valve 1112 may include a controller (e.g., processing circuit, memory, control module, etc.) or may be communicable with a controller (e.g., central controller, etc.) configured to control the defrost control valve 1112.

The defrost control valve 1112 is positioned upstream of a conduit, shown as a defrost inlet conduit 1114. The defrost inlet conduit 1114 provides refrigerant to defrost targets, such as display cases and evaporators, to be defrosted. By controlling the defrost control valve 1112 (e.g., progressively opening the defrost control valve, 1112, progressively closing the defrost control valve 1112, etc.) more or less gas may be provided or discharged from the low temperature compressor system 1102 to the medium temperature compressor system 1106 thereby causing more or less gas to be provided from the low temperature compressor system 1102 to the defrost inlet conduit 1114. When the defrost control valve 1112 is closed, the pressure $P_2$ upstream of the defrost control valve 1112 increases and additional refrigerant is provided to the defrost inlet conduit 1114.

Downstream of the medium temperature compressor system 1106 is a conduit, shown as a heat exchange conduit 1116. The heat exchange conduit 1116 couples the medium temperature compressor system 1106 to a separator (e.g., can, canister, etc.), shown as an oil separator 1118. The oil separator 1118 is configured to separate oil from the refrigerant that is provided from the medium temperature compressor system 1106.

The refrigeration system 1100 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 1120. The defrost heat exchanger 1120 includes a first circuit, shown as a first circuit 1122, and a second circuit, shown as a second circuit 1124. The first circuit 1122 is positioned along the heat exchange conduit 1116 such that the first circuit 1122 receives the refrigerant from the oil separator 1118. The second circuit 1124 is positioned along the defrost inlet conduit 1114 such that the second circuit 1124 receives the refrigerant from the low temperature compressor system 1102.

Due to the additional compression of the refrigerant provided by the medium temperature compressor system 1106, the fourth temperature $T_4$ is greater than the second temperature $T_2$. As a result of this temperature difference, the defrost heat exchanger 1120 is configured to transfer heat from the refrigerant in the first circuit 1122 to the refrigerant in the second circuit 1124, such that the refrigerant has a fifth temperature $T_5$ greater than the second temperature $T_2$ prior to the refrigerant being provided to the defrost targets. This refrigerant also has a fifth pressure $P_5$. In this way, the refrigerant that is provided to the defrost targets, such as display cases and evaporators, to be defrosted is provided with additional heat. This additional heat may cause the refrigerant to become superheated.

The refrigeration system 1100 also includes a valve (e.g., regulating valve, solenoid valve, ball valve, etc.), shown as a three-way defrost control valve 1126, a conduit, shown as a bypass conduit 1128, and a condenser (e.g., gas cooler, heat exchanger, etc.), shown as a condenser 1130. The condenser 1130 is configured to receive the refrigerant from the heat exchange conduit 1116 downstream of the three-way defrost control valve 1126.

The three-way defrost control valve 1126 has a first opening coupled to the heat exchange conduit 1116 downstream of the first circuit 1122, a second opening coupled to the heat exchange conduit 1116 upstream of the condenser 1130, and a third opening coupled to the bypass conduit 1128 which is further coupled to the heat exchange conduit 1116 upstream of the first circuit 1122. The three-way defrost control valve 1126 is configured to be controlled to regulate flow of the refrigerant through the first circuit 1122, and therefore the rate of heat exchange between the first circuit 1122 and the second circuit 1124, such that the fifth temperature $T_5$ is at or below a target temperature associated with providing desirable cooling to the defrost targets receiving refrigerant from the defrost inlet conduit 1114. Specifically, the three-way defrost control valve 1126 operates to create a target pressure differential between a sixth pressure $P_6$, upstream of the three-way defrost control valve 1126 and downstream of the oil separator 1118, and a seventh pressure $P_7$, downstream of the three-way defrost control valve 1126 and upstream of the condenser 1130.

The refrigeration system 1100 also includes a valve (e.g., regulating valve, solenoid valve, ball valve, etc.), shown as a defrost control valve 1132. The defrost control valve 1132 is positioned along the heat exchange conduit 1116 downstream of an outlet of the first circuit 1122. The defrost control valve 1132 is configured to be selectively opened and closed to control the flow of the refrigerant through the first circuit 1122, and therefore the rate of heat exchange between the first circuit 1122 and the second circuit 1124, such that the fifth temperature $T_5$ is at or within a target tolerance of a target temperature associated with providing desirable defrost results to the defrost targets receiving refrigerant from the defrost inlet conduit 1114. The target temperature may be fixed or may be adjusted (e.g., varied, altered, etc.) continuously based on parameters (e.g., amount of frost or ice, pressure of the refrigerant, temperature of the refrigerant, etc.). By progressively closing the defrost control valve 1132, the flow of the refrigerant from the medium temperature compressor system 1106 is slowed and the pressure of the refrigerant in the heat exchange conduit 1116 upstream of the three-way defrost control valve 1126, such as the sixth pressure $P_6$, increases, thereby increasing the temperature of the refrigerant in the heat exchange conduit 1116 upstream of the defrost control valve 1126, such as the sixth temperature $T_6$.

The refrigeration system 1100 also includes a conduit, shown as a parallel load inlet conduit 1134. The parallel load inlet conduit 1134 receives the refrigerant from the heat exchange conduit 1116 downstream of the oil separator 1118 and upstream of the first circuit 1122. The parallel load inlet conduit 1134 provides the refrigerant to one or more other loads that utilize heat provided by the medium temperature compressor system 1106 (e.g., in heat reclaim applications, etc.). The one or more other loads utilize the heat to create a target pressure differential between the sixth pressure $P_6$, upstream of the three-way defrost control valve 1126 and downstream of the oil separator 1118, and the seventh pressure $P_7$, downstream of the three-way defrost control valve 1126 and upstream of the condenser 1130, that is less than a pressure differential threshold.

The refrigeration system 1100 also includes a conduit, shown as a parallel load outlet conduit 1136. The parallel load outlet conduit 1136 provides refrigerant from the one or more other loads that utilized heat from the medium temperature compressor system 1106 back to the heat exchange conduit 1116 downstream of the three-way defrost control valve 1126 and upstream of the condenser 1130.

After flowing from the defrost inlet conduit 1114 through the defrost targets to be defrosted, the refrigerant is directed through a defrost outlet conduit 1138. The defrost outlet conduit 1138 provides the refrigerant to a reservoir, shown as a flash tank 1140. The flash tank 1140 is configured to also receive the refrigerant from the condenser 1130. The flash tank 1140 provides the refrigerant to a conduit, shown as a vent conduit 1142. The vent conduit 1142 is fluidly coupled to the conduit 1110 and may provide the refrigerant to the medium temperature compressor system 1106.

The refrigeration system 1100 also includes a valve (e.g., regulating valve, solenoid valve, ball valve, etc.), shown as a vent valve 1144 disposed on the vent conduit 1142. The vent valve 1144 is configured to selectively vent refrigerant from the flash tank 1140 through the vent conduit 1142 to the medium temperature compressor system 1106. For example, the vent valve 1144 may be controlled to vent refrigerant from the flash tank 1140 to the medium temperature compressor system 1106 when the fifth pressure $P_5$, or the pressure at another point within the defrost system (e.g., along and between the defrost inlet conduit 1114 and the defrost outlet conduit 1138, etc.) exceeds a threshold.

In various embodiments, the pressure of the refrigerant in the defrost outlet conduit 1138, the defrost targets, and the defrost inlet conduit 1114 can be varied by adjusting the pressure of the refrigerant in the flash tank 1140. The pressure of the refrigerant in the flash tank 1140 can be adjusted changing the threshold at which the vent valve 1144 opens. For example, while the refrigerant is flowing through the defrost targets, the fifth pressure $P_5$ may exceed a previously set threshold but the vent valve 1144 is controlled to remain closed so as to cause the pressure of the refrigerant between the defrost inlet conduit 1114 and the defrost outlet conduit 1138 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1100 more desirable. The vent valve 1144 can be electronically controlled such that the pressure of the refrigerant between the defrost inlet conduit 1114 and the defrost outlet conduit 1138 can be easily selected based on the defrost targets.

The refrigeration system 1100 may also include a conduit, shown as a return conduit 1146. The return conduit 1146 is coupled to the conduit 1110, downstream of the defrost control valve 1112 and upstream of the medium temperature compressor system 1106, and to an inlet of the low temperature compressor system 1102. The return conduit 1146 is configured to selectively provide refrigerant from an inlet of the medium temperature compressor system 1106 to an inlet of the low temperature compressor system 1102.

The refrigeration system 1100 may also include a valve (e.g., regulating valve, solenoid valve, ball valve, etc.), shown as a return control valve 1148, disposed on the return conduit 1146. The return control valve 1148 is configured to be selectively opened and closed to control a flow of the refrigerant through the return conduit 1146. When refrigerant is provided from the return conduit 1146 to the inlet of the low temperature compressor system 1102, the refrigerant creates a "false load" on the low temperature compressor system 1102, thereby causing additional refrigerant to be provided to the low temperature compressor system 1102 and therefore to the defrost inlet conduit 1114.

The refrigeration system 1100 may also include a valve (e.g., regulating valve, solenoid valve, ball valve, etc.), shown as a return isolation valve 1150 disposed on the return conduit 1146. In an exemplary embodiment, the return isolation valve 1150 is disposed upstream of the return control valve 1148. The return isolation valve 1150 is configured to selectively isolate the portion of the return conduit 1146 that is downstream of the return isolation valve 1150, and therefore the low temperature compressor system 1102, from the portion of the return conduit 1146 that is upstream of the return isolation valve 1150, and therefore the medium temperature compressor system 1106. In various embodiments, the return isolation valve 1150 is configured to perform such an isolation in response to determining that a pressure, such as the first pressure $P_1$, is above a threshold.

Figure 12:
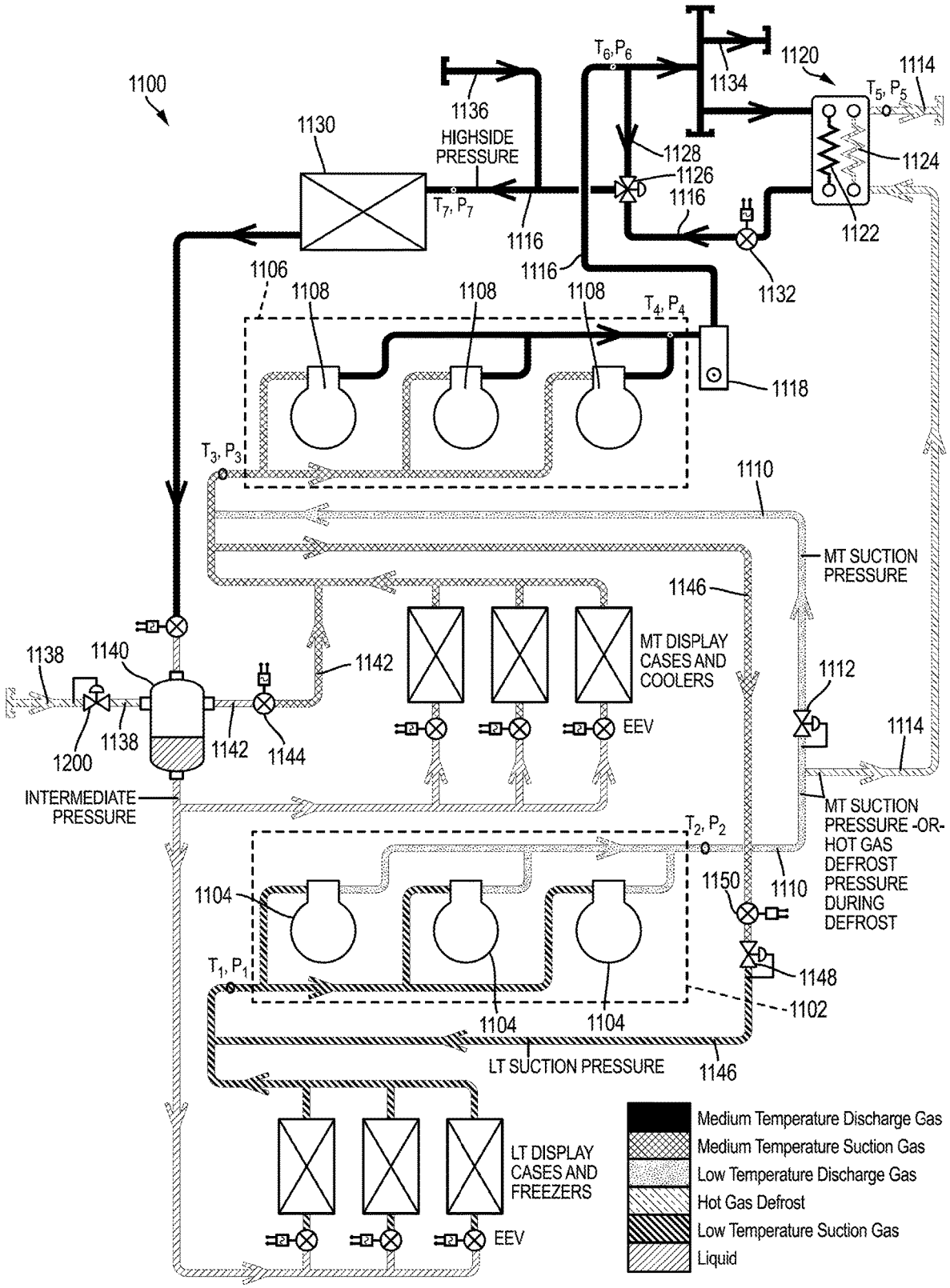
FIG. 12 is a schematic representation of the refrigeration system shown in FIG. 11 according to some embodiments.

FIG. 12 illustrates another implementation of the refrigeration system 1100. In this implementation, the refrigeration system 1100 further includes a valve (e.g., regulating valve, solenoid valve, ball valve, etc.), shown as a pressure regulator 1200, disposed on the defrost outlet conduit 1138. The pressure regulator 1200 is configured to be selectively opened and closed to control a flow of the refrigerant through the defrost targets being heated by the refrigerant from the defrost inlet conduit 1114 and into the flash tank 1140. For example, by progressively closing the pressure regulator 1200, the pressure within the defrost inlet conduit 1114 and the defrost outlet conduit 1138 is progressively increased and the flow rate of the refrigerant out of the defrost outlet conduit 1138 and into the flash tank 1140 is progressively decreased, thereby facilitating longer exposure of the refrigerant to the defrost targets and providing greater heating to the defrost targets (e.g., to melt the ice disposed thereon, etc.). The pressure regulator 1200 and the defrost control valve 1112 can be cooperatively controlled to establish a target pressure within the defrost system (e.g., along and between the defrost inlet conduit 1114 and the defrost outlet conduit 1138, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1100 more desirable. The pressure regulator 1200 and/or the defrost control valve 1112 can be electronically controlled such that the pressure of the refrigerant therebetween can be easily selected based on the defrost targets.

Figure 13:
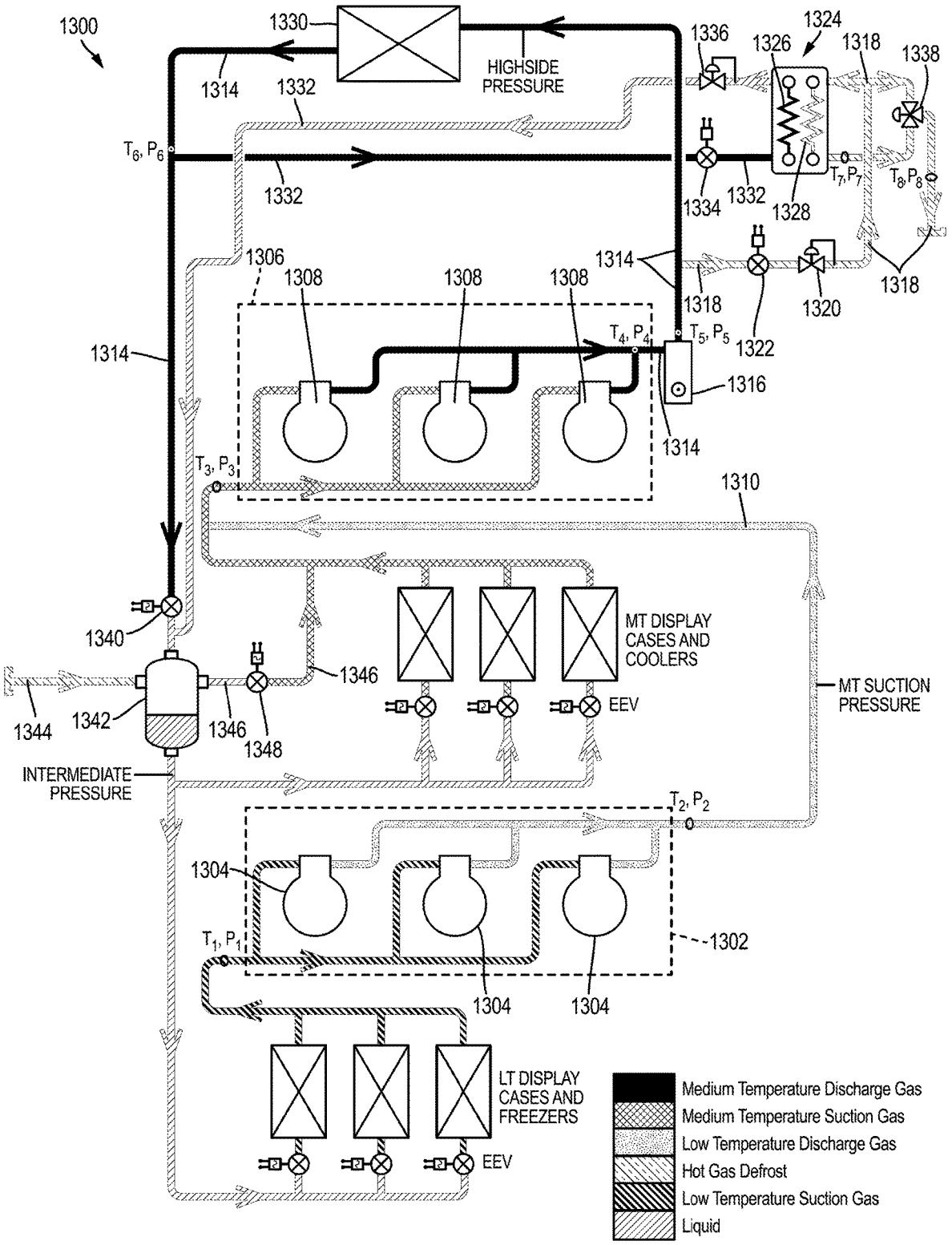
FIG. 13 is a schematic representation of a refrigeration system, according to yet another exemplary embodiment of the present disclosure.

Referring to FIG. 13, a system (e.g., cooling system, etc.), shown as a refrigeration system 1300, is illustrated. The refrigeration system 1300 is implemented in at least one refrigerated case for refrigerating goods. For example, the refrigeration system 1300 may be implemented in a bank of refrigerated cases, each sharing the refrigeration system 1300. As will be explained in more detail herein, the refrigeration system 1300 functions to provide or discharge hot gas (e.g., superheated gas, etc.) to a gas defrost system for defrosting components of the at least one refrigerated case, such as components of the refrigeration system 1300.

The refrigeration system 1300 circulates a refrigerant gas. In various locations within the refrigeration system 1300, the gas may become saturated and/or phase shift partially to liquid. Additionally, the gas may become superheated at various locations within the refrigeration system 1300. In various exemplary embodiments described herein, the refrigeration system 1300 utilizes $CO_2$ as a refrigerant, which may exist in a liquid and/or gaseous state according to the temperature and pressure conditions throughout the various locations of the refrigeration system 1300. In these embodiments, the refrigeration system 1300 may be termed a "$CO_2$ refrigeration system." However, in other embodiments the refrigeration system 1300 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 1300 includes a first compressor system, shown as a low temperature compressor system 1302. The low temperature compressor system 1302 includes a plurality of compressors, shown as low temperature compressors 1304. The low temperature compressor system 1302 may include one, two, three, four, or more low temperature compressors 1304. The low temperature compressors 1304 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 1300 includes a second compressor system, shown as a medium temperature compressor system 1306. The medium temperature compressor system 1306 includes a plurality of compressors, shown as medium temperature compressors 1308. The medium temperature compressor system 1306 may include one, two, three, four, or more medium temperature compressors 1308. The medium temperature compressors 1308 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 1306 is configured to receive gas from the low temperature compressor system 1302 via a conduit (e.g., line, pipe, etc.), shown as a conduit 1310. The conduit 1310 is coupled to an outlet of the low temperature compressor system 1302 and an inlet of the medium temperature compressor system 1306.

Downstream of the medium temperature compressor system 1306 is a conduit, shown as a heat exchange conduit 1314. The heat exchange conduit 1314 couples the medium temperature compressor system 1306 to a separator (e.g., can, canister, etc.), shown as an oil separator 1316. The oil separator 1316 is configured to separate oil from the refrigerant that is provided from the medium temperature compressor system 1306.

The heat exchange conduit 1314 is coupled to a conduit, shown as a defrost inlet conduit 1318. The defrost inlet conduit 1318 includes a first portion that provides refrigerant to a valve (e.g., regulating valve, solenoid valve, ball valve, etc.), shown as a pressure reducing valve 1320, and a second portion that provides the refrigerant from the pressure reducing valve 1320. The pressure reducing valve 1320 is configured to reduce a pressure of the refrigerant as the refrigerant flows through the defrost inlet conduit 1318. The portion of the defrost inlet conduit 1318 upstream of the pressure reducing valve 1320 may be configured to withstand relatively high pressures while the portion of the defrost inlet conduit 1318 downstream of the pressure reducing valve 1320 may be configured to withstand relatively low pressures. In this way, cost of the defrost inlet conduit 1318 may be minimized.

The refrigeration system 1300 also includes a valve (e.g., regulating valve, solenoid valve, ball valve, etc.), shown as a defrost isolation valve 1322 disposed on the defrost inlet conduit 1318. In an exemplary embodiment, the defrost isolation valve 1322 is disposed upstream of the pressure reducing valve 1320. The defrost isolation valve 1322 is configured to selectively isolate the portion of the defrost inlet conduit 1318 that is downstream of the defrost isolation valve 1322, and therefore the medium temperature compressor system 1306, from the portion of the defrost inlet conduit 1318 that is upstream of the defrost isolation valve 1322. In various embodiments, the defrost isolation valve 1322 is configured to perform such an isolation in response to determining that a pressure, such as a fifth pressure $P_5$, is above a threshold.

The refrigeration system 1300 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 1324. The defrost heat exchanger 1324 includes a first circuit, shown as a first circuit 1326, and a second circuit, shown as a second circuit 1328.

The refrigeration system 1300 also includes a heat exchanger (e.g., gas cooler, tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a condenser 1330. The condenser 1330 is positioned along the heat exchange conduit 1314 such that the condenser 1330 receives the refrigerant from the oil separator 1316. The condenser 1330 provides the refrigerant back to the heat exchange conduit 1314. The refrigeration system 1300 also includes a conduit, shown as a recirculation conduit 1332. The recirculation conduit 1332 receives the refrigerant from the heat exchange conduit 1314 downstream of the condenser 1330 and provides the refrigerant to the first circuit 1326.

The refrigeration system 1300 also includes a valve (e.g., regulating valve, solenoid valve, ball valve, etc.), shown as an expansion valve 1334 disposed on the recirculation conduit 1332. The expansion valve 1334 is configured to facilitate an expansion of the refrigerant prior to the refrigerant entering the first circuit 1326. In this way, the expansion valve 1334 controls superheat of the refrigerant exiting the first circuit 1326. The refrigeration system 1300 also includes a valve (e.g., regulating valve, solenoid valve, ball valve, etc.), shown as a pressure regulator 1336. The pressure regulator 1336 is disposed along the recirculation conduit 1332 downstream of the first circuit 1326 and is configured to regulate a pressure of the refrigerant flowing through the recirculation conduit 1332.

The second circuit 1328 receives the refrigerant from the defrost inlet conduit 1318. The condenser 1330 reduces the temperature of the refrigerant to a sixth temperature $T_6$. This refrigerant also has a sixth pressure $P_6$. As a result of this temperature difference, the defrost heat exchanger 1324 is configured to transfer heat from the refrigerant in the second circuit 1328 to the refrigerant in the first circuit 1326, such that the refrigerant has a seventh temperature $T_7$ less than the fifth temperature $T_5$, effectively cooling the refrigerant output from the medium temperature compressor system 1306 prior to the refrigerant being provided for defrost to the defrost targets. This refrigerant also has a seventh pressure $P_7$.

The refrigeration system 1300 also includes a valve (e.g., regulating valve, solenoid valve, ball valve, etc.), shown as a three-way defrost control valve 1338. The three-way defrost control valve 1338 has a first opening coupled to the defrost inlet conduit 1318 downstream of the pressure reducing valve 1320, a second opening coupled to the defrost inlet conduit 1318 downstream of the second circuit 1328, and a third opening coupled to the defrost inlet conduit 1318 upstream of the defrost targets.

The three-way defrost control valve 1338 is configured to be controlled to regulate flow of the refrigerant through the second circuit 1328 and to regulate flow of the refrigerant around the second circuit 1328, and therefore the rate of heat exchange between the first circuit 1326 and the second circuit 1328, such that the refrigerant has an eighth temperature $T_8$ that is at or within a target tolerance of a target temperature associated with providing desirable defrost results in the defrost targets receiving refrigerant from the defrost inlet conduit 1318. In this way, the eighth temperature $T_8$ is a function of the seventh temperature $T_7$ and the fifth temperature $T_5$. The target temperature may be fixed or may be adjusted continuously based on parameters (e.g., temperature, pressure, level of ice deposits, etc.) of the defrost targets. The refrigerant downstream of the three-way defrost control valve 1338 also has an eighth pressure $P_8$. The three-way defrost control valve 1338 provides the refrigerant to defrost targets, such as display cases and evaporators, to be defrosted.

Similarly, the expansion valve 1334 is configured to be selectively opened and closed to control the flow of the refrigerant through the recirculation conduit 1332, and therefore the rate of heat exchange between the first circuit 1326 and the second circuit 1328, such that three-way defrost control valve 1338 is capable of providing the refrigerant at the eighth temperature $T_8$ being at below a target temperature associated with providing desirable cooling to the defrost targets receiving refrigerant from the defrost inlet conduit 1318.

The refrigeration system 1300 also includes a valve (e.g., regulating valve, solenoid valve, ball valve, etc.), shown as a high pressure control valve 1340. The high pressure control valve 1340 control an amount of the refrigerant that is provided from the heat exchange conduit 1314 to the recirculation conduit 1332 by controlling an amount of the refrigerant that may flow from the heat exchange conduit 1314 into a tank, shown as a flash tank 1342, which also receives refrigerant from the recirculation conduit 1332 downstream of the pressure regulator 1336. For example, the more open the recirculation control valve, the less refrigerant that flows into the first circuit 1326, and subsequently into the flash tank 1342, via the recirculation conduit 1332, and the more refrigerant that flows directly into the flash tank 1342, via the heat exchange conduit 1314. The flash tank 1342 also receives the refrigerant from a conduit, shown as a defrost outlet conduit 1344, which receives the refrigerant from the defrost targets.

The flash tank 1342 provides the refrigerant to a conduit, shown as a vent conduit 1346. The vent conduit 1346 is fluidly coupled to the conduit 1310 and may provide the refrigerant to the medium temperature compressor system 1306. The refrigeration system 1300 also includes a valve (e.g., regulating valve, solenoid valve, ball valve, etc.), shown as a vent valve 1348 disposed on the vent conduit 1346. The vent valve 1348 is configured to selectively vent refrigerant from the flash tank 1342 through the vent conduit 1346 to the medium temperature compressor system 1306. For example, the vent valve 1348 may be controlled to vent refrigerant from the flash tank 1342 to the medium temperature compressor system 1306 when the eighth pressure $P_8$, or the pressure at another point within the defrost system (e.g., along and between the defrost inlet conduit 1318 and the defrost outlet conduit 1344, etc.) exceeds a threshold.

In various embodiments, the pressure of the refrigerant in the defrost outlet conduit 1344, the defrost targets, and the defrost inlet conduit 1318 can be varied by adjusting the pressure of the refrigerant in the flash tank 1342. The pressure of the refrigerant in the flash tank 1342 can be adjusted changing the threshold at which the vent valve 1348 opens. For example, while the refrigerant is flowing through the defrost targets, the fifth pressure $P_5$ may exceed a previously set threshold but the vent valve 1348 is controlled to remain closed so as to cause the pressure of the refrigerant between the defrost inlet conduit 1318 and the defrost outlet conduit 1344 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1300 more desirable. The vent valve 1348 can be electronically controlled such that the pressure of the refrigerant between the defrost inlet conduit 1318 and the defrost outlet conduit 1344 can be easily selected based on the defrost targets.

While not shown in FIG. 13, it is understood that the refrigeration system 1300 could be modified in various similarly operating arrangements. In one example, a heat exchanger is positioned between the high pressure control valve 1340 and the flash tank 1342 and the defrost heat exchanger 1324 and the expansion valve 1334 are removed. In these embodiments, the defrost inlet conduit 1318 routes the refrigerant through a first circuit, similar to the first circuit 1326, of the heat exchanger that is positioned between the high pressure control valve 1340 and the flash tank 1342.

The refrigeration system 1300 is configured such that various conduits, such as the portion of the defrost inlet conduit 1318 that is downstream of the pressure reducing valve 1320 and the portion of the heat exchange conduit 1314 downstream of the high pressure control valve 1340 are constructed from material with a lower pressure rating than various conduits, such as the conduit 1310, the portion of the defrost inlet conduit 1318 that is upstream of the pressure reducing valve 1320, and the defrost outlet conduit 1344. In this way, the refrigeration system 1300 is capable of minimizing costs associated conduits that do not contain refrigerant in a high pressure state.

Figure 14:
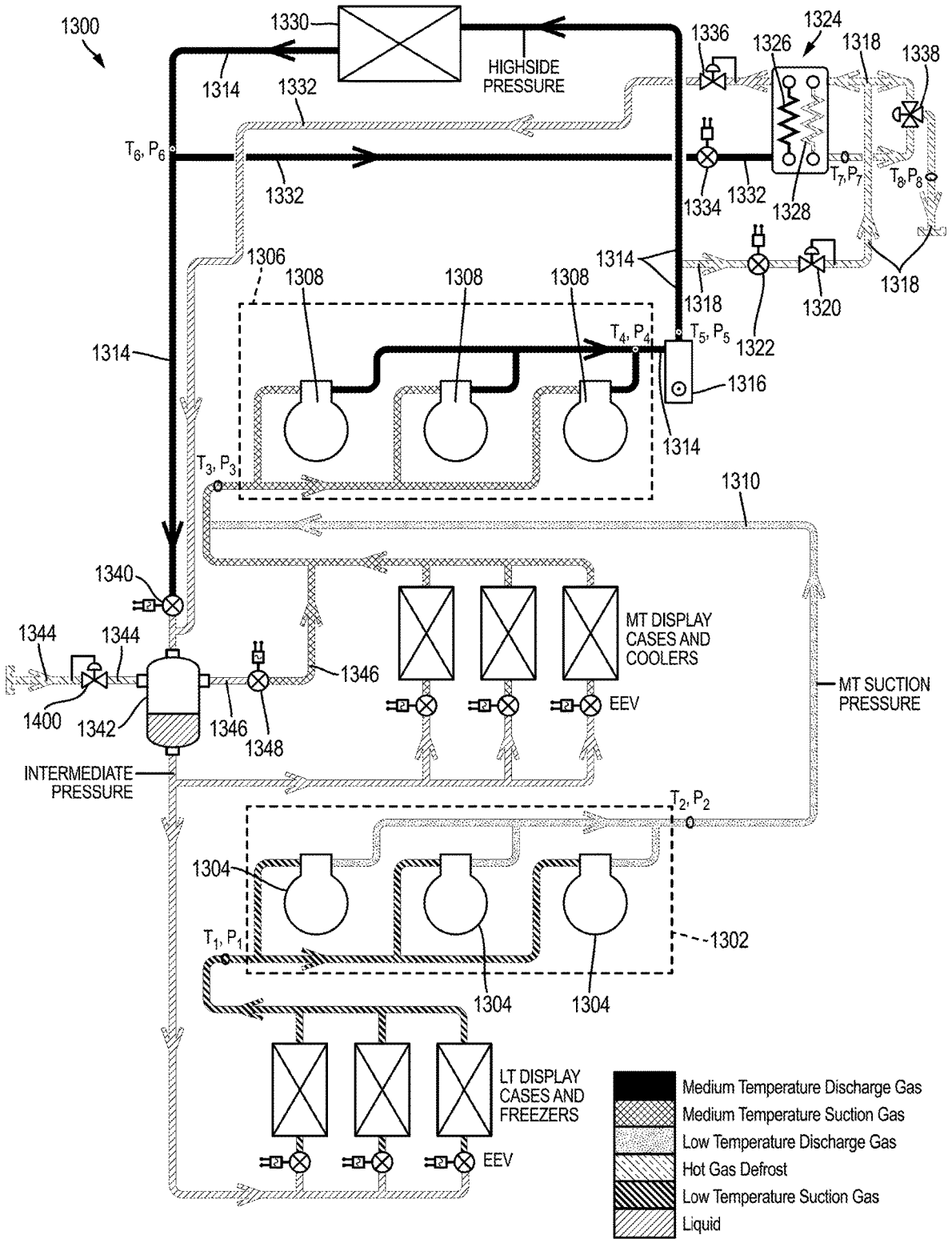
FIG. 14 is a schematic representation of the refrigeration system shown in FIG. 13 according to some embodiments.

FIG. 14 illustrates another implementation of the refrigeration system 1300. In this implementation, the refrigeration system 1300 further includes a valve (e.g., regulating valve, solenoid valve, ball valve, etc.), shown as a pressure regulator 1400, disposed on the defrost outlet conduit 1344. The pressure regulator 1400 is configured to be selectively opened and closed to control a flow of the refrigerant through the defrost targets being heated by the refrigerant from the defrost inlet conduit 1318 and into the flash tank 1342. For example, by progressively closing the pressure regulator 1400, the pressure within the defrost inlet conduit 1318 and the defrost outlet conduit 1344 is progressively increased and the flow rate of the refrigerant out of the defrost outlet conduit 1344 and into the flash tank 1342 is progressively decreased, thereby facilitating longer exposure of the refrigerant to the defrost targets and providing greater heating to the defrost targets (e.g., to melt the ice disposed thereon, etc.). The pressure regulator 1400 and the three-way defrost control valve 1338 can be cooperatively controlled to establish a target pressure within the defrost system (e.g., along and between the defrost inlet conduit 1318 and the defrost outlet conduit 1344, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1300 more desirable. The pressure regulator 1400 and/or the three-way defrost control valve 1338 can be electronically controlled such that the pressure of the refrigerant therebetween can be easily selected based on the defrost targets.

Figure 15:
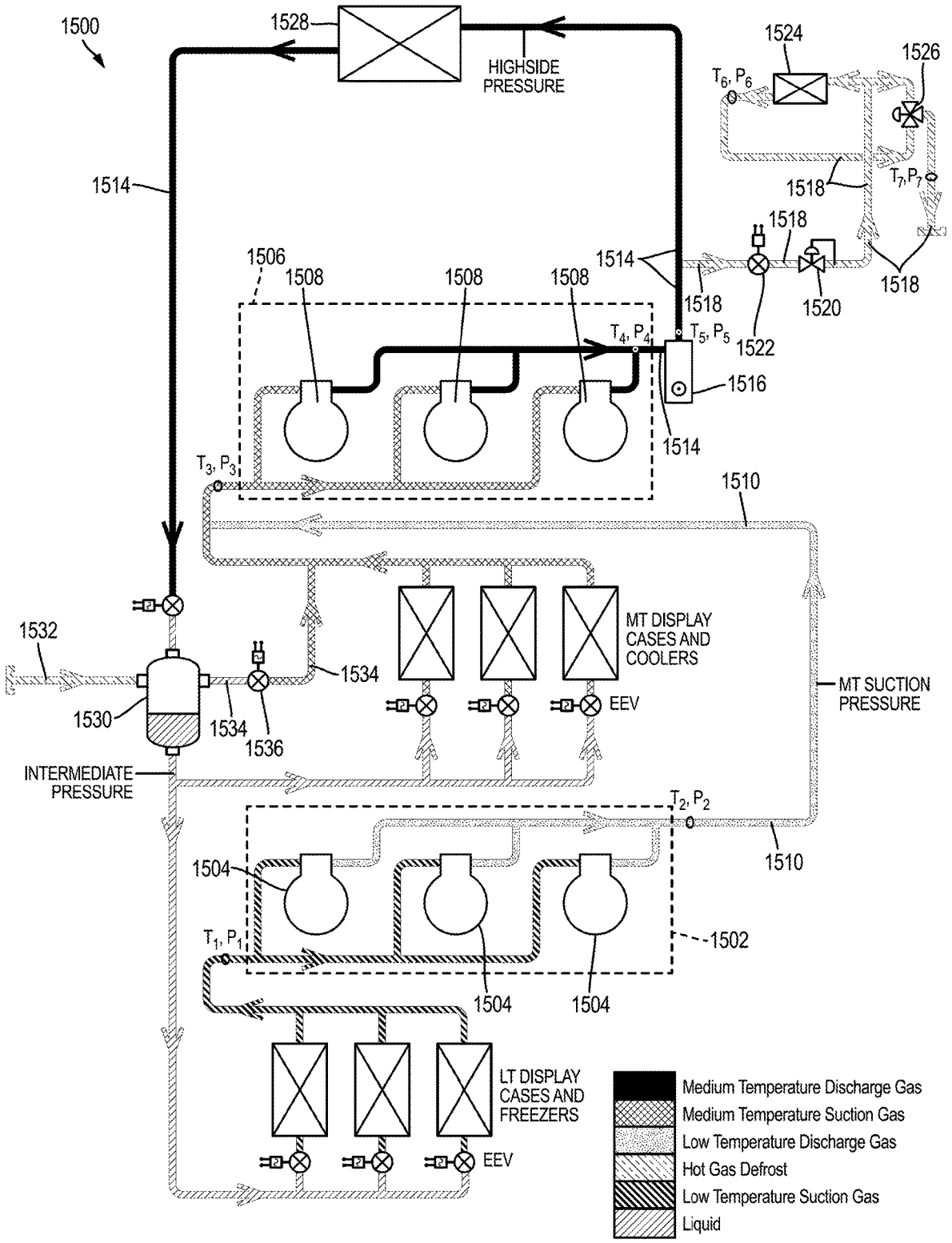
FIG. 15 is a schematic representation of a refrigeration system, according to yet another exemplary embodiment of the present disclosure.

Referring to FIG. 15, a system (e.g., cooling system, etc.), shown as a refrigeration system 1500, is illustrated. The refrigeration system 1500 is implemented in at least one refrigerated case for refrigerating goods. For example, the refrigeration system 1500 may be implemented in a bank of refrigerated cases, each sharing the refrigeration system 1500. As will be explained in more detail herein, the refrigeration system 1500 functions to provide or discharge hot gas (e.g., superheated gas, etc.) to a gas defrost system for defrosting components of the at least one refrigerated case, such as components of the refrigeration system 1500.

The refrigeration system 1500 circulates a refrigerant gas. In various locations within the refrigeration system 1500, the gas may become saturated and/or phase shift partially to liquid. Additionally, the gas may become superheated at various locations within the refrigeration system 1500. In various exemplary embodiments described herein, the refrigeration system 1500 utilizes $CO_2$ as a refrigerant, which may exist in a liquid and/or gaseous state according to the temperature and pressure conditions throughout the various locations of the refrigeration system 1500. In these embodiments, the refrigeration system 1500 may be termed a "$CO_2$ refrigeration system." However, in other embodiments the refrigeration system 1500 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 1500 includes a first compressor system, shown as a low temperature compressor system 1502. The low temperature compressor system 1502 includes a plurality of compressors, shown as low temperature compressors 1504. The low temperature compressor system 1502 may include one, two, three, four, or more low temperature compressors 1504. The low temperature compressors 1504 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 1500 includes a second compressor system, shown as a medium temperature compressor system 1506. The medium temperature compressor system 1506 includes a plurality of compressors, shown as medium temperature compressors 1508. The medium temperature compressor system 1506 may include one, two, three, four, or more medium temperature compressors 1508. The medium temperature compressors 1508 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 1506 is configured to receive gas from the low temperature compressor system 1502 via a conduit (e.g., line, pipe, etc.), shown as a conduit 1510. The conduit 1510 is coupled to an outlet of the low temperature compressor system 1502 and an inlet of the medium temperature compressor system 1506.

Downstream of the medium temperature compressor system 1506 is a conduit, shown as a heat exchange conduit 1514. The heat exchange conduit 1514 couples the medium temperature compressor system 1506 to a separator (e.g., can, canister, etc.), shown as an oil separator 1516. The oil separator 1516 is configured to separate oil from the refrigerant that is provided from the medium temperature compressor system 1506.

The heat exchange conduit 1514 is coupled to a conduit, shown as a defrost inlet conduit 1518. The defrost inlet conduit 1518 provides refrigerant to a valve (e.g., regulating valve, solenoid valve, ball valve, etc.), shown as a pressure reducing valve 1520. The pressure reducing valve 1520 is configured to reduce a pressure of the refrigerant as the refrigerant flows through the defrost inlet conduit 1518.

The refrigeration system 1500 also includes a valve (e.g., regulating valve, solenoid valve, ball valve, etc.), shown as a defrost isolation valve 1522 disposed on the defrost inlet conduit 1518. In an exemplary embodiment, the defrost isolation valve 1522 is disposed upstream of the pressure reducing valve 1520. The defrost isolation valve 1522 is configured to selectively isolate the portion of the defrost inlet conduit 1518 that is downstream of the defrost isolation valve 1522, and therefore the medium temperature compressor system 1506, from the portion of the defrost inlet conduit 1518 that is upstream of the defrost isolation valve 1522. In various embodiments, the defrost isolation valve 1522 is configured to perform such an isolation in response to determining that a pressure, such as a fifth pressure $P_5$, is above a threshold.

The refrigeration system 1500 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 1524. The defrost heat exchanger 1524 receives the refrigerant from the defrost inlet conduit 1518. The defrost heat exchanger 1524 reduces the temperature of the refrigerant to a sixth temperature $T_6$ at an outlet of the defrost heat exchanger 1524, effectively cooling the refrigerant output from the medium temperature compressor system 1506 prior to the refrigerant being provided to the defrost targets. This refrigerant also has a sixth pressure $P_6$. Unlike the defrost heat exchanger 1324, the defrost heat exchanger 1524 provides cooling to the refrigerant using only air or chilled fluid from a different source (e.g., rather than using refrigerant of a different temperature, etc.).

The refrigeration system 1500 also includes a valve (e.g., regulating valve, solenoid valve, ball valve, etc.), shown as a three-way defrost control valve 1526. The three-way defrost control valve 1526 has a first opening coupled to the defrost inlet conduit 1518 downstream of the pressure reducing valve 1520, a second opening coupled to the defrost inlet conduit 1518 downstream of the defrost heat exchanger 1524, and a third opening coupled to the defrost inlet conduit 1518 upstream of the defrost targets.

The three-way defrost control valve 1526 is configured to be controlled to regulate flow of the refrigerant through the defrost heat exchanger 1524 and therefore the cooling of the refrigerant in the defrost inlet conduit 1518, such that the refrigerant has a seventh temperature $T_7$ that is at or within a target tolerance of a target temperature associated with providing desirable defrost results in the defrost targets receiving refrigerant from the defrost inlet conduit 1518. In this way, the seventh temperature $T_7$ is a function of the fifth temperature $T_5$ and the sixth temperature $T_6$. The target temperature may be fixed or may be adjusted continuously based on parameters (e.g., temperature, pressure, level of ice deposits, etc.) of the defrost targets. The refrigerant downstream of the three-way defrost control valve 1526 also has a seventh pressure $P_7$. The three-way defrost control valve 1526 provides the refrigerant to defrost targets, such as display cases and evaporators, to be defrosted.

The refrigeration system 1500 also includes a heat exchanger (e.g., gas cooler, tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a condenser 1528. The condenser 1528 is positioned along the heat exchange conduit 1514 such that the condenser 1528 receives the refrigerant from the oil separator 1516. The condenser 1528 provides the refrigerant back to the heat exchange conduit 1514.

The refrigeration system 1500 also includes a tank, shown as a flash tank 1530, which receives refrigerant from the heat exchange conduit 1514 downstream of the condenser 1528. The flash tank 1530 also receives the refrigerant from a conduit, shown as a defrost outlet conduit 1532, which receives the refrigerant from the defrost targets.

The flash tank 1530 provides the refrigerant to a conduit, shown as a vent conduit 1534. The vent conduit 1534 is fluidly coupled to the conduit 1510 and may provide the refrigerant to the medium temperature compressor system 1506. The refrigeration system 1500 also includes a valve (e.g., regulating valve, solenoid valve, ball valve, etc.), shown as a vent valve 1536 disposed on the vent conduit 1534. The vent valve 1536 is configured to selectively vent refrigerant from the flash tank 1530 through the defrost outlet conduit 1532 to the medium temperature compressor system 1506. For example, the vent valve 1536 may be controlled to vent refrigerant from the flash tank 1530 to the medium temperature compressor system 1506 when the seventh pressure $P_7$, or the pressure at another point within the defrost system (e.g., along and between the defrost inlet conduit 1518 and the defrost outlet conduit 1532, etc.) exceeds a threshold.

In various embodiments, the pressure of the refrigerant in the defrost outlet conduit 1532, the defrost targets, and the defrost inlet conduit 1518 can be varied by adjusting the pressure of the refrigerant in the flash tank 1530. The pressure of the refrigerant in the flash tank 1530 can be adjusted changing the threshold at which the vent valve 1536 opens. For example, while the refrigerant is flowing through the defrost targets, the fifth pressure $P_5$ may exceed a previously set threshold but the vent valve 1536 is controlled to remain closed so as to cause the pressure of the refrigerant between the defrost inlet conduit 1518 and the defrost outlet conduit 1532 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1500 more desirable. The vent valve 1536 can be electronically controlled such that the pressure of the refrigerant between the defrost inlet conduit 1518 and the defrost outlet conduit 1532 can be easily selected based on the defrost targets.

Figure 16:
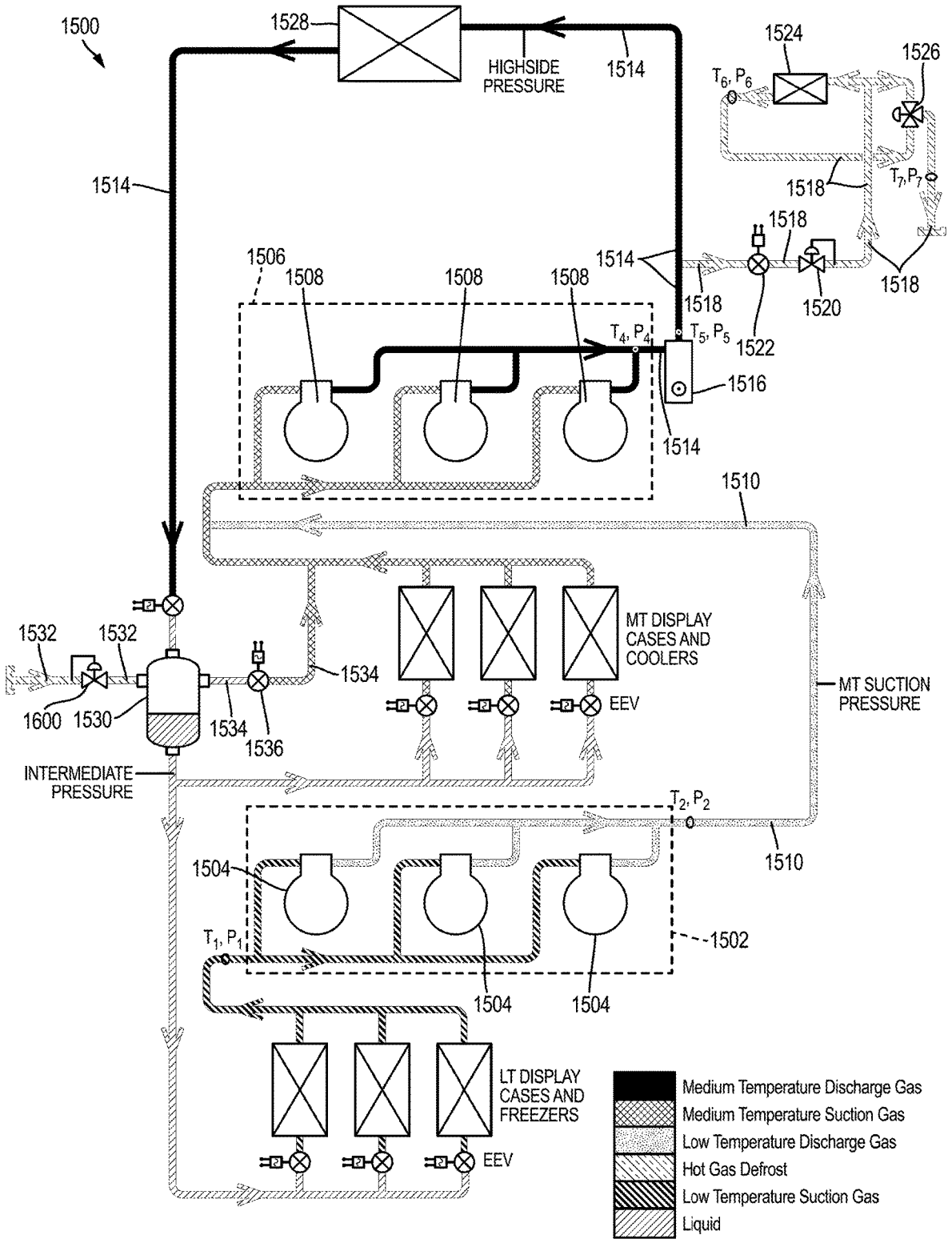
FIG. 16 is a schematic representation of the refrigeration system shown in FIG. 15 according to some embodiments.

FIG. 16 illustrates another implementation of the refrigeration system 1500. In this implementation, the refrigeration system 1500 further includes a valve (e.g., regulating valve, solenoid valve, ball valve, etc.), shown as a pressure regulator 1600, disposed on the defrost outlet conduit 1532. The pressure regulator 1600 is configured to be selectively opened and closed to control a flow of the refrigerant through the defrost targets being heated by the refrigerant from the defrost inlet conduit 1518 and into the flash tank 1530. For example, by progressively closing the pressure regulator 1600, the pressure within the defrost inlet conduit 1518 and the defrost outlet conduit 1532 is progressively increased and the flow rate of the refrigerant out of the defrost outlet conduit 1532 and into the flash tank 1530 is progressively decreased, thereby facilitating longer exposure of the refrigerant to the defrost targets and providing greater heating to the defrost targets (e.g., to melt the ice disposed thereon, etc.). The pressure regulator 1600 and the three-way defrost control valve 1526 can be cooperatively controlled to establish a target pressure within the defrost system (e.g., along and between the defrost inlet conduit 1518 and the defrost outlet conduit 1532, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1500 more desirable. The pressure regulator 1600 and/or the three-way defrost control valve 1526 can be electronically controlled such that the pressure of the refrigerant therebetween can be easily selected based on the defrost targets.

Figure 17:
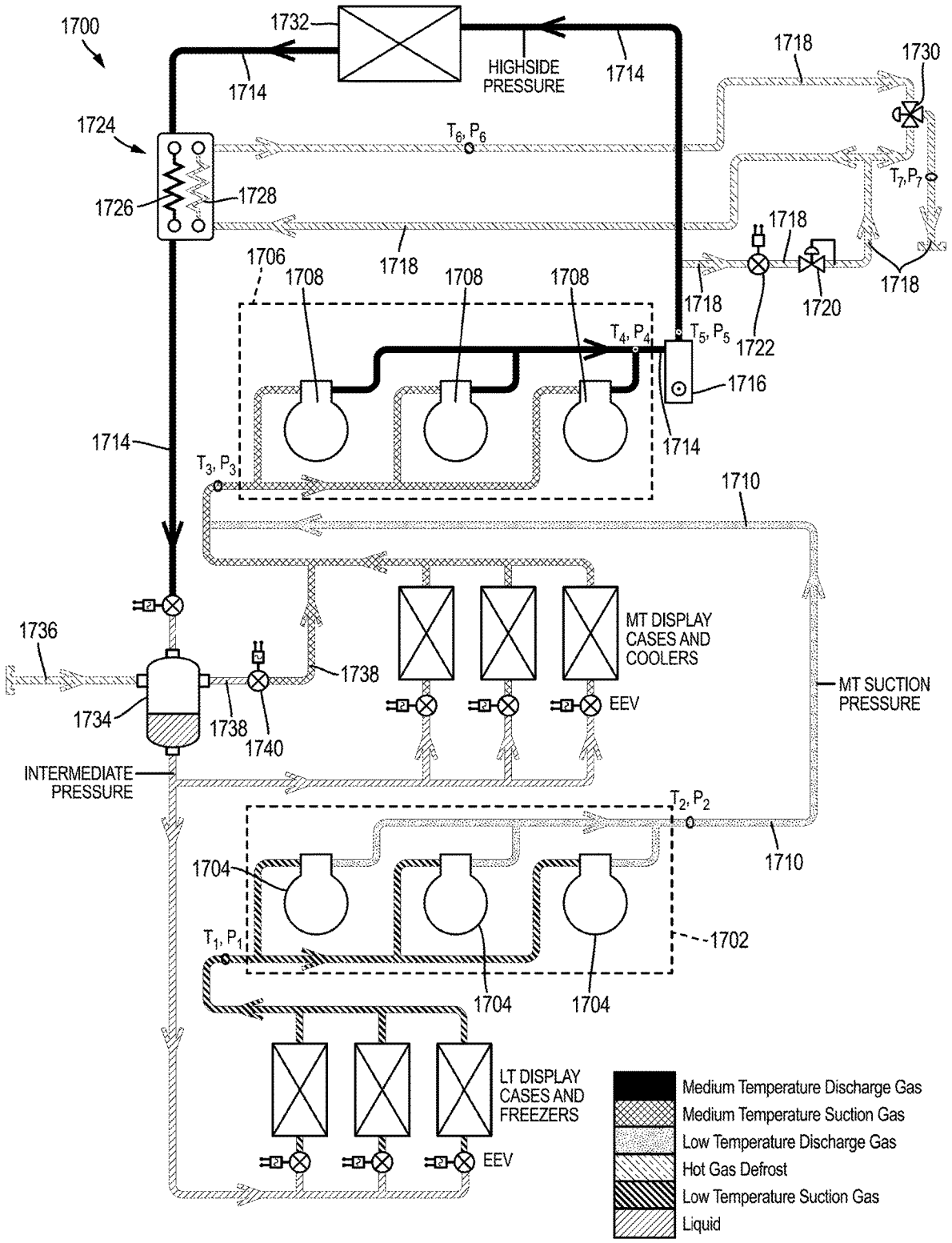
FIG. 17 is a schematic representation of a refrigeration system, according to yet another exemplary embodiment of the present disclosure.

Referring to FIG. 17, a system (e.g., cooling system, etc.), shown as a refrigeration system 1700, is illustrated. The refrigeration system 1700 is implemented in at least one refrigerated case for refrigerating goods. For example, the refrigeration system 1700 may be implemented in a bank of refrigerated cases, each sharing the refrigeration system 1700. As will be explained in more detail herein, the refrigeration system 1700 functions to provide or discharge hot gas (e.g., superheated gas, etc.) to a gas defrost system for defrosting components of the at least one refrigerated case, such as components of the refrigeration system 1700.

The refrigeration system 1700 circulates a refrigerant gas. In various locations within the refrigeration system 1700, the gas may become saturated and/or phase shift partially to liquid. Additionally, the gas may become superheated at various locations within the refrigeration system 1700. In various exemplary embodiments described herein, the refrigeration system 1700 utilizes $CO_2$ as a refrigerant, which may exist in a liquid and/or gaseous state according to the temperature and pressure conditions throughout the various locations of the refrigeration system 1700. In these embodiments, the refrigeration system 1700 may be termed a "$CO_2$ refrigeration system." However, in other embodiments the refrigeration system 1700 may utilize other similar working fluids such as, for example, R-401A, R-404A, R-406A, R-407A, R-407C, R-408A, R-409A, R-410A, R-438A, R-448A, R-449A, R-500, R-502, and R-1234yf.

The refrigeration system 1700 includes a first compressor system, shown as a low temperature compressor system 1702. The low temperature compressor system 1702 includes a plurality of compressors, shown as low temperature compressors 1704. The low temperature compressor system 1702 may include one, two, three, four, or more low temperature compressors 1704. The low temperature compressors 1704 are configured to receive the gas at a first temperature $T_1$ and a first pressure $P_1$ and provide or discharge the gas at a second temperature $T_2$ greater than the first temperature $T_1$ and a second pressure $P_2$ greater than the first pressure $P_1$ (e.g., via a polytropic compression process, etc.).

The refrigeration system 1700 includes a second compressor system, shown as a medium temperature compressor system 1706. The medium temperature compressor system 1706 includes a plurality of compressors, shown as medium temperature compressors 1708. The medium temperature compressor system 1706 may include one, two, three, four, or more medium temperature compressors 1708. The medium temperature compressors 1708 are configured to receive the gas at a third temperature $T_3$ and a third pressure $P_3$ and provide or discharge the gas at a fourth temperature $T_4$ greater than the third temperature $T_3$ and a fourth pressure $P_4$ greater than the third pressure $P_3$ (e.g., via a polytropic compression process, etc.).

The medium temperature compressor system 1706 is configured to receive gas from the low temperature compressor system 1702 via a conduit (e.g., line, pipe, etc.), shown as a conduit 1710. The conduit 1710 is coupled to an outlet of the low temperature compressor system 1702 and an inlet of the medium temperature compressor system 1706.

Downstream of the medium temperature compressor system 1706 is a conduit, shown as a heat exchange conduit 1714. The heat exchange conduit 1714 couples the medium temperature compressor system 1706 to a separator (e.g., can, canister, etc.), shown as an oil separator 1716. The oil separator 1716 is configured to separate oil from the refrigerant that is provided from the medium temperature compressor system 1706.

The heat exchange conduit 1714 is coupled to a conduit, shown as a defrost inlet conduit 1718. The defrost inlet conduit 1718 provides refrigerant to a valve (e.g., regulating valve, solenoid valve, ball valve, etc.), shown as a pressure reducing valve 1720. The pressure reducing valve 1720 is configured to reduce a pressure of the refrigerant as the refrigerant flows through the defrost inlet conduit 1718.

The refrigeration system 1700 also includes a valve (e.g., regulating valve, solenoid valve, ball valve, etc.), shown as a defrost isolation valve 1722 disposed on the defrost inlet conduit 1718. In an exemplary embodiment, the defrost isolation valve 1722 is disposed upstream of the pressure reducing valve 1720. The defrost isolation valve 1722 is configured to selectively isolate the portion of the defrost inlet conduit 1718 that is downstream of the defrost isolation valve 1722, and therefore the medium temperature compressor system 1706, from the portion of the defrost inlet conduit 1718 that is upstream of the defrost isolation valve 1722. In various embodiments, the defrost isolation valve 1722 is configured to perform such an isolation in response to determining that a pressure, such as a fifth pressure $P_5$, is above a threshold.

The refrigeration system 1700 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a defrost heat exchanger 1724. The defrost heat exchanger 1724 includes a first circuit, shown as a first circuit 1726, and a second circuit, shown as a second circuit 1728. The second circuit 1728 receives the refrigerant from the defrost inlet conduit 1718 and provides the refrigerant back to the defrost inlet conduit 1718. The defrost heat exchanger 1724 reduces the temperature of the refrigerant flowing through the second circuit 1728 to a sixth temperature $T_6$ at an outlet of the second circuit 1728 of the defrost heat exchanger 1724, effectively cooling the refrigerant output from the medium temperature compressor system 1706 prior to the refrigerant being provided to the defrost targets. This refrigerant also has a sixth pressure $P_6$.

The refrigeration system 1700 also includes a valve (e.g., regulating valve, solenoid valve, ball valve, etc.), shown as a three-way defrost control valve 1730. The three-way defrost control valve 1730 has a first opening coupled to the defrost inlet conduit 1718 downstream of the pressure reducing valve 1720, a second opening coupled to the defrost inlet conduit 1718 downstream of the second circuit 1728 of the defrost heat exchanger 1724, and a third opening coupled to the defrost inlet conduit 1718 upstream of the defrost targets.

The three-way defrost control valve 1730 is configured to be controlled to regulate flow of the refrigerant through the defrost heat exchanger 1724 and therefore the cooling of the refrigerant in the defrost inlet conduit 1718, such that the refrigerant has a seventh temperature $T_7$ that is at or below a target temperature associated with providing desirable cooling to the defrost targets receiving refrigerant from the defrost inlet conduit 1718. In this way, the seventh temperature $T_7$ is a function of the fifth temperature $T_5$ and the sixth temperature $T_6$. The target temperature may be fixed or may be adjusted continuously based on parameters (e.g., temperature, pressure, level of ice deposits, etc.) of the defrost targets. The refrigerant downstream of the three-way defrost control valve 1730 also has a seventh pressure $P_7$. The three-way defrost control valve 1730 provides the refrigerant to defrost targets, such as display cases and evaporators, to be defrosted.

The refrigeration system 1700 also includes a heat exchanger (e.g., tubular heat exchanger, shell and tube heat exchanger, plate heat exchanger, plate and shell heat exchanger, wheel heat exchanger, plate fin heat exchanger, pillow plate heat exchanger, fluid heat exchanger, direct contact heat exchanger, microchannel heat exchanger, etc.), shown as a condenser 1732. The condenser 1732 is positioned along the heat exchange conduit 1714 such that the condenser 1732 receives the refrigerant from the oil separator 1716. The condenser 1732 provides the refrigerant back to the heat exchange conduit 1714. The first circuit 1726 receives the refrigerant from the heat exchange conduit 1714 downstream of the condenser 1732. In this way, cooling provided to the refrigerant in the condenser 1732 is transferred to the refrigerant in the second circuit 1728.

The refrigeration system 1700 also includes a tank, shown as a flash tank 1734, which receives refrigerant from the heat exchange conduit 1714 downstream of the condenser 1732.

The flash tank 1734 also receives the refrigerant from a conduit, shown as a defrost outlet conduit 1736, which receives the refrigerant from the defrost targets.

The flash tank 1734 provides the refrigerant to a conduit, shown as a vent conduit 1738. The vent conduit 1738 is fluidly coupled to the conduit 1710 and may provide the refrigerant to the medium temperature compressor system 1706. The refrigeration system 1700 also includes a valve (e.g., regulating valve, solenoid valve, ball valve, etc.), shown as a vent valve 1740 disposed on the vent conduit 1738. The vent valve 1740 is configured to selectively vent refrigerant from the flash tank 1734 through the vent conduit 1738 to the medium temperature compressor system 1706. For example, the vent valve 1740 may be controlled to vent refrigerant from the flash tank 1734 to the medium temperature compressor system 1706 when the seventh pressure $P_7$, or the pressure at another point within the defrost system (e.g., along and between the defrost inlet conduit 1718 and the defrost outlet conduit 1736, etc.) exceeds a threshold.

In various embodiments, the pressure of the refrigerant in the defrost outlet conduit 1736, the defrost targets, and the defrost inlet conduit 1718 can be varied by adjusting the pressure of the refrigerant in the flash tank 1734. The pressure of the refrigerant in the flash tank 1734 can be adjusted changing the threshold at which the vent valve 1740 opens. For example, while the refrigerant is flowing through the defrost targets, the fifth pressure $P_5$ may exceed a previously set threshold but the vent valve 1740 is controlled to remain closed so as to cause the pressure of the refrigerant between the defrost inlet conduit 1718 and the defrost outlet conduit 1736 to increase to a target pressure. This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1700 more desirable. The vent valve 1740 can be electronically controlled such that the pressure of the refrigerant between the defrost inlet conduit 1718 and the defrost outlet conduit 1736 can be easily selected based on the defrost targets.

Figure 18:
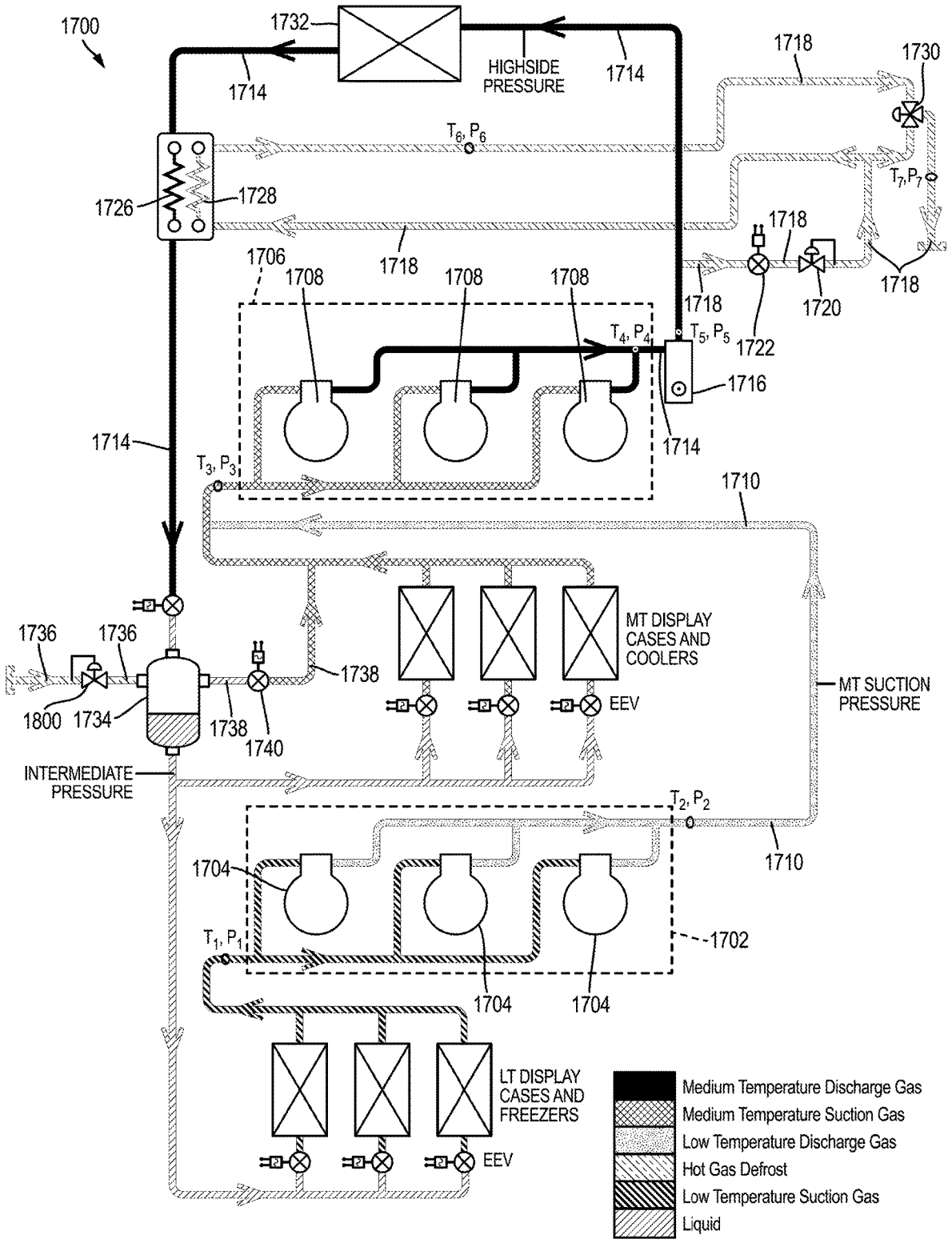
FIG. 18 is a schematic representation of the refrigeration system shown in FIG. 17 according to some embodiments.

FIG. 18 illustrates another implementation of the refrigeration system 1700. In this implementation, the refrigeration system 1700 further includes a valve (e.g., regulating valve, solenoid valve, ball valve, etc.), shown as a pressure regulator 1800, disposed on the defrost outlet conduit 1736. The pressure regulator 1800 is configured to be selectively opened and closed to control a flow of the refrigerant through the defrost targets being heated by the refrigerant from the defrost inlet conduit 1718 and into the flash tank 1734. For example, by progressively closing the pressure regulator 1800, the pressure within the defrost inlet conduit 1718 and the defrost outlet conduit 1736 is progressively increased and the flow rate of the refrigerant out of the defrost outlet conduit 1736 and into the flash tank 1734 is progressively decreased, thereby facilitating longer exposure of the refrigerant to the defrost targets and providing greater heating to the defrost targets (e.g., to melt the ice disposed thereon, etc.). The pressure regulator 1800 and the three-way defrost control valve 1730 can be cooperatively controlled to establish a target pressure within the defrost system (e.g., along and between the defrost inlet conduit 1718 and the defrost outlet conduit 1736, etc.). This target pressure can be selected based upon an accepted working pressure of the defrost targets. It is advantageous to utilize the highest possible target pressure because the refrigerant (e.g., $CO_2$, etc.) then condenses (e.g., phase changes from a gas into a liquid, etc.) at the highest possible temperature, thereby providing for the highest possible differential between the temperature of ice on the defrost targets which is being defrosted and the temperature of the refrigerant, facilitating the most rapid melting of the ice from the defrost targets, and making the refrigeration system 1700 more desirable. The pressure regulator 1800 and/or the three-way defrost control valve 1730 can be electronically controlled such that the pressure of the refrigerant therebetween can be easily selected based on the defrost targets.

III. Configuration of Exemplary Embodiments

As utilized herein, the terms "parallel," "substantially," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The term "coupled" and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being coupled to one another.

References herein to the positions of elements are merely used to describe the orientation of various elements in the Figures. It should be noted that the orientation of various elements may differ according to other exemplary embodiments and that such variations are intended to be encompassed by the present disclosure.

The construction and arrangement of the elements of the refrigeration systems and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any of the apertures may not be included or may be replaced with internal holes, such that a fastener may be positioned within an aligned and adjacent aperture, may extend into the internal hole, and may not extend from the internal hole out of the body adjacent the internal hole. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A refrigeration system comprising:

a first compressor system comprising a first compressor;

a second compressor system comprising a second compressor;

a first conduit configured to provide refrigerant from the first compressor system to the second compressor system;

a defrost inlet conduit coupled downstream of the second compressor system and upstream of a condenser, the defrost inlet conduit configured to provide refrigerant from the second compressor system to one or more defrost targets; and a pressure reducing valve positioned in the defrost inlet conduit, the pressure reducing valve configured to reduce a pressure in the defrost inlet conduit downstream of the pressure reducing valve.

2. The refrigeration system of claim 1, further comprising an oil separator coupled downstream of the second compressor system and upstream of the defrost inlet conduit.

3. The refrigeration system of claim 2, further comprising:

a second conduit fluidly coupled to the second compressor system, the oil separator, and the defrost inlet conduit, wherein the second conduit is configured to receive the refrigerant from the oil separator.

4. The refrigeration system of claim 3, further comprising:

a defrost isolation valve disposed along the second conduit upstream of the pressure reducing valve.

5. The refrigeration system of claim 4, wherein the condenser is disposed along the second conduit downstream of the defrost isolation valve and the oil separator, the condenser configured to cool the refrigerant.

6. The refrigeration system of claim 1, further comprising:

a high pressure control valve disposed downstream of the condenser.

7. The refrigeration system of claim 6, further comprising a flash tank configured to receive the refrigerant from the high pressure control valve.

8. The refrigeration system of claim 1, further comprising a defrost outlet conduit, the defrost outlet conduit configured to:

receive refrigerant from the one or more defrost targets; and provide the refrigerant from the one or more defrost targets to the first compressor system.

9. The refrigeration system of claim 7, further comprising a defrost outlet conduit, the defrost outlet conduit configured to:

receive refrigerant from the one or more defrost targets; and provide the refrigerant from the one or more defrost targets to the flash tank.

10. The refrigeration system of claim 9, further comprising a vent conduit coupled between the flash tank and the second compressor system, the vent conduit configured to conduct vented refrigerant from the flash tank to the second compressor system.

11. The refrigeration system of claim 10, further comprising a vent valve disposed in the vent conduit, the vent valve configured to selectively vent refrigerant from the flash tank through the vent conduit to the second compressor system.

12. The refrigeration system of claim 11, wherein the vent valve is further configured to vent refrigerant from the flash tank to the second compressor system responsive to a pressure in the defrost inlet conduit exceeding a pressure threshold.

13. The refrigeration system of claim 12, wherein the pressure in the defrost inlet conduit is upstream of the pressure reducing valve.

14. The refrigeration system of claim 12, wherein the pressure in the defrost inlet conduit is downstream of the pressure reducing valve.

15. The refrigeration system of claim 12, wherein the vent valve is configured to:

adjust a pressure of the refrigerant in the flash tank; and responsive to adjusting the pressure of the refrigerant in the flash tank, varying the pressure of the refrigerant in at least one of the defrost outlet conduit, the one or more defrost targets, and the defrost inlet conduit.

16. The refrigeration system of claim 12, wherein the pressure threshold is an accepted working pressure of the one or more defrost targets.

17. The refrigeration system of claim 12, wherein the pressure threshold is a maximum target pressure at a maximum temperature, the maximum temperature providing for a maximum differential between a temperature of ice on the one or more defrost targets and a temperature of the refrigerant.

18. The refrigeration system of claim 4, wherein the defrost isolation valve is configured to be selectively positioned to prevent a flow of the refrigerant through the second conduit.

19. The refrigeration system of claim 4, wherein the defrost isolation valve is configured to isolate the defrost inlet conduit responsive to a determination that a pressure in the defrost inlet conduit is above a pressure threshold.

20. The refrigeration system of claim 1, further comprising a controller, the controller operatively coupled to the pressure reducing valve, the controller configured to perform operations comprising operating the pressure reducing valve to provide refrigerant to the one or more defrost targets.

21. The refrigeration system of claim 20, further comprising a sensor positioned in the defrost inlet conduit, the sensor configured to:

sense a temperature and a pressure of the refrigerant in the defrost inlet conduit; and transmit a signal representing the temperature and the pressure of the refrigerant in the defrost inlet conduit to the controller.

22. The refrigeration system of claim 21, wherein operating the pressure reducing valve to provide refrigerant to the one or more defrost targets comprises, based on the at least one of the temperature or the pressure of the refrigerant in the defrost inlet conduit, controlling the pressure of the refrigerant provided to the one or more defrost targets.

23. The refrigeration system of claim 22, wherein controlling the pressure of the refrigerant provided to the one or more defrost targets comprises:

progressively closing the pressure reducing valve; and responsive to progressively closing the pressure reducing valve, increasing the pressure of the refrigerant provide to the one or more defrost targets.

24. The refrigeration system of claim 21, wherein operating the pressure reducing valve to provide refrigerant to the one or more defrost targets comprises, based on the at least one of the temperature or the pressure of the refrigerant in the defrost inlet conduit, controlling a flow rate of the refrigerant provided to the one or more defrost targets.

25. The refrigeration system of claim 8, further comprising a pressure regulator disposed on the defrost outlet conduit, the pressure regulator configured to be selectively opened and closed to control a flow of the refrigerant through the one or more defrost targets.

26. The refrigeration system of claim 25, wherein the pressure regulator is further configured to provide the refrigerant from the one or more defrost targets to downstream of the first compressor system.

27. The refrigeration system of claim 25, wherein the pressure regulator is further configured to provide the refrigerant from the one or more defrost targets to a flash tank positioned between the condenser and the first compressor system.

28. The refrigeration system of claim 27, wherein the pressure regulator is configured to:

progressively closing the pressure regulator to control the flow of the refrigerant through the one or more defrost targets;

responsive to the pressure regulator progressively closing, progressively increasing the pressure within the defrost inlet conduit and the defrost outlet conduits; and responsive to the pressure regulator progressively closing, progressively decreasing a flow rate of the refrigerant out of the defrost outlet conduit and into the flash tank.

29. The refrigeration system of claim 27, wherein the pressure regulator is configured to be cooperatively controlled with the pressure reducing valve to control a target pressure of the one or more defrost targets.

* * * * *